US008864411B2

(12) United States Patent
Taylor

(10) Patent No.: US 8,864,411 B2
(45) Date of Patent: Oct. 21, 2014

(54) WATER MANAGEMENT BARRIERS, SYSTEMS, AND METHODS OF USING THE SAME

(75) Inventor: Jaren Taylor, Logan, UT (US)

(73) Assignee: Muscle Wall, LLC, Logan, UT (US)

( * ) Notice: Subject to any disclaimer, the term of this patent is extended or adjusted under 35 U.S.C. 154(b) by 239 days.

(21) Appl. No.: 13/485,071

(22) Filed: May 31, 2012

(65) Prior Publication Data

US 2012/0315093 A1 Dec. 13, 2012

Related U.S. Application Data

(63) Continuation-in-part of application No. 12/623,172, filed on Nov. 20, 2009, now Pat. No. 8,313,265.

(60) Provisional application No. 61/117,523, filed on Nov. 24, 2008.

(51) Int. Cl.
*E02B 7/02* (2006.01)
*E02B 3/10* (2006.01)

(52) U.S. Cl.
CPC ..... *E02B 3/108* (2013.01)
USPC ..... 405/114; 405/112; 405/116

(58) Field of Classification Search
USPC ..... 405/107, 110–112, 114, 116; 404/6
See application file for complete search history.

(56) References Cited

U.S. PATENT DOCUMENTS 4,681,302 A 7/1987 Thompson
4,689,617 A 8/1987 Costa
4,690,588 A 9/1987 Berger
5,123,773 A 6/1992 Yodlock
5,435,669 A 7/1995 Weber
5,531,540 A 7/1996 Wasserstrom
D385,362 S 10/1997 Rossetti
D400,264 S 10/1998 Striefel
6,059,491 A 5/2000 Striefel et al.
6,485,224 B1 11/2002 Dyke
D479,883 S 9/2003 Gresham
6,672,800 B2 1/2004 Frank
6,840,711 B1 1/2005 Martinez
6,863,468 B2 3/2005 Davis
D533,281 S 12/2006 Christensen et al.
D552,250 S 10/2007 Christensen
7,364,385 B1 4/2008 Luke
D569,992 S 5/2008 Christensen
D572,374 S 7/2008 Gibbs (Continued)

OTHER PUBLICATIONS

U.S. Appl. No. 29/423,388, filed May 31, 2012, Taylor.

(Continued)

*Primary Examiner* — Tara M. Pinnock
(74) *Attorney, Agent, or Firm* — Workman Nydegger

(57) ABSTRACT

In an embodiment, a water management barrier may include a hollow body at least partially defined by a front wall, a back wall, a top portion, a bottom portion, a first end, and a second end. The front wall may include a plurality of raised portions spaced from each other and extending substantially between the top portion and the bottom portion. The raised portions may at least partially define a plurality of channels extending substantially between said top portion and said bottom portion. The raised portions and/or the channels may be configured to help the front wall resist deformation due to one or more forces being exerted on the front wall. The barrier may also include an elongated connection member connection to the first end and a connection recess formed in the second end. The barrier may also include an elongated foot member attached to the bottom portion.

22 Claims, 24 Drawing Sheets

(56) References Cited

U.S. PATENT DOCUMENTS

| | | | |
|---|---|---|---|
| 7,445,403 | B2 | 11/2008 | Williams |
| D631,977 | S | 2/2011 | Taylor |
| D634,443 | S | 3/2011 | Taylor |
| 7,931,422 | B2 | 4/2011 | Kulp |
| 2013/0071188 | A1 | 3/2013 | Taylor |

OTHER PUBLICATIONS

U.S. Appl. No. 29/423,388, May 22, 2013, Notice of Allowance.
U.S. Appl. No. 12/623,172, Jul. 23, 2012, Notice of Allowance.
U.S. Appl. No. 29/423,388, Aug. 14, 2013, Notice of Allowance.
U.S. Appl. No. 13/674,819, May 8, 2014, Office Action.
U.S. Appl. No. 29/350,685, Jun. 30, 2010, Notice of Allowance.
U.S. Appl. No. 29/375,962, Sep. 30, 2010, Notice of Allowance.
U.S. Appl. No. 12/623,172, Dec. 22, 2011, Office Action.

WATER MANAGEMENT BARRIERS, SYSTEMS, AND METHODS OF USING THE SAME

CROSS-REFERENCE TO RELATED APPLICATIONS

This application is a continuation-in-part of, and claims the benefit of, and priority to, U.S. patent application Ser. No. 12/623,172, filed on Nov. 20, 2009 now U.S. Pat. No. 8,313,265, and entitled "WATER MANAGEMENT BARRIER AND SYSTEM," which claim the benefit of, and priority to, U.S. Provisional Patent Application Ser. No. 61/117,523, filed on Nov. 24, 2008 and entitled "FLOOD BARRIER WITH PIVOTING CONNECTOR," each of which is hereby incorporated herein in its entirety by this reference.

BACKGROUND OF THE INVENTION

1. Field of the Invention

Example embodiments of the invention relate to devices, systems and methods for controlling flood waters. More particularly, example embodiments relate to a flood control barrier that is versatile, light-weight, cost effective, and reusable.

2. Related Technology

Traditionally, various types of barriers have been used to control flood waters, examples of which are sandbags, traffic barricades and bladder systems. Flood water control barriers are inherently a temporary solution to a temporary flood problem. Thus, flood control barriers may be sized such that individuals or groups of individuals may maneuver and set up the flood control barriers. Traditional flood control barriers are also usually designed such that once the flood control need has passed, then the flood control barriers may be removed. Importantly, of course, flood control barriers must be designed to hold back the extremely large force produced by flood waters.

Although traditional flood control barriers attempt to accomplish the above goals, such flood control barriers are nonetheless often expensive, difficult or time consuming to install, or don't adequately control flood waters in some situations. For example, sandbags, which are still the most commonly used means of controlling flood waters, may appear inexpensive because the bag can be produced and transported at relatively low cost; however, the true cost of sandbags is significantly higher when one considers the cost of the sand, filling and transporting the sandbags, and the number of sandbags needed to make an effective sandbag levee. In particular, a sandbag levee that is one mile long and four feet tall may require in excess of 400,000 sandbags. The total cost of sandbags, including labor, sand, and cleanup costs, can result in a significant cost to build a sandbag levee. For example, the total cost of a four foot high one mile sandbag levee would typically be in the range of a million dollars. Moreover, the amount of time it takes to fill and place 400,000 sandbags often is prohibitive in that some flood emergencies do not allow time to create an adequate flood control barrier with sandbags.

Additionally, once the flood waters subside, the sandbags typically are left in the sun to dry for several weeks due to the labor intensive process involved in moving sandbags that are wet. Thus, weeks after flood waters subside, the sandbags may still be blocking roads and other transportation routes. Furthermore, since the sand in the sandbags absorbs the flood water, including flood water contamination such as oil, gas, raw sewage, and other contaminates, the sandbags and the sand are not reusable. Therefore, used sandbags, including the sand, are usually hauled to a landfill where they fill huge amounts of space in the landfill.

On the other hand, in some situations, some communities have attempted to use traffic barriers, such as concrete lane dividers, as flood control barriers. However, traffic barriers are not specifically designed to retain and redirect flood waters, and result in a less than optimal solution. Specifically, traffic barriers are not easily adaptable to the contour of the terrain. Moreover, when two traffic barriers are connected together, the connection does not provide a tight seal to prevent the flood waters from passing between the barriers. Further, traffic barriers are often heavy, thus increasing the cost and time required to transport and assemble a flood control barrier.

Water-filled bladder systems used as flood control barriers are also considered to have substantial drawbacks. For example, flood waters may contain all types of debris. When that debris moves within the flood waters and contacts the rubber, water-filled bladder systems on the market today, such water-filled bladder systems can be punctured or otherwise incur substantial damage that makes them useless and non-reusable. Moreover, ground slope can also create situations where the water-filled bladders are ineffective.

What is desired, therefore, is a flood and water management device and system that, among other characteristics, is reusable, light-weight, adaptable to the contour of the terrain, and cost effective.

BRIEF SUMMARY OF THE INVENTION

Example embodiments of the invention relate to devices, systems and methods for controlling and managing flood or other waters. More particularly, example embodiments relate to a water management apparatus that acts as a barrier and is versatile, light-weight, cost-effective, and reusable. For instance, example embodiments of the invention provide a water management barrier that is versatile to the contour of the landscape allowing the water management barrier to be used on a wide variety of landscapes. Additionally, embodiments of the invention offer a light-weight water management barrier that can easily be maneuvered and assembled by one or two people. Further, embodiments of the invention provide a cost-effective system for setting up and removing a water management barrier wall since the water management barriers can be reused, are designed for easy storage, and require significantly less labor to assemble and disassemble relative to traditional flood control barriers.

More specifically, a single water management barrier of an example embodiment disclosed herein can replace up to four-hundred and sixty-eight sandbags. One or two people may also be able to set-up and assemble a water management barrier into a water management system in about three to five minutes. Thus, the water management barrier saves time and money from potential damage caused by flooding, and can therefore also be an effective way at limiting damage to property and/or saving lives that may be at risk when immediate flood control is needed.

In an embodiment, a water management barrier may include a hollow body at least partially defined by a front wall, a back wall, a top portion extending between the front wall and the back wall, a bottom portion generally opposite the top portion, a first end extending between the first top portion and the bottom portion, and a second end extending between the top portion and the bottom portion. The hollow body may exhibit a height generally defined between the top portion and the bottom portion and may be configured to receive one or more pourable materials to at least partially fill the hollow body. The front wall may include a plurality of raised portions spaced from each other and extending between the top portion and the bottom portion. The raised portions may at least partially define a plurality of channels extending substantially between the top portion and the bottom portion. The raised portions and/or the channels may be configured to help the front wall resist deformation due to one or more internal forces and/or one or more external forces being exerted on said front wall. The barrier may also include an elongated connection member connected to the first end and generally extending between the top portion and the bottom portion. The barrier may also include a connection recess formed in the second end. The connection recess may be sized and configured to generally correspond to at least a portion of the connection member. Finally, the barrier may include an elongated foot member attached to said bottom portion.

In another embodiment, a water management barrier may include a hollow body at least partially defined by a front wall, a back wall, a top portion extending between the front wall and the back wall, a bottom portion generally opposite the top portion, a first end extending between the first top portion and the bottom portion, and a second end extending between the top portion and the bottom portion. The hollow body may exhibit a height generally defined between the top portion and the bottom portion and may be configured to receive one or more pourable materials to at least partially fill the hollow body. The barrier may also include an elongated connection member connected to the first end and generally extending between the top portion and the bottom portion. The barrier may also include a connection recess formed in the second end. The connection recess may be sized and configured to generally correspond to at least a portion of the connection member. The barrier may also include a foot member attached to the back wall. The foot member may include a curved portion and a toe-like portion extending from the curved portion. The toe-like portion may exhibit a length generally defined between the curved portion and a free end of the toe-like portion. The length of the toe-like portion may be between about ten percent and one-hundred percent of the height of the hollow body. The length of the toe-like portion may be configured to help produce a resisting overturning moment to help prevent the hollow body from being tipped over during use.

In yet another embodiment, a water management wall may include a first water management barrier rotatably connected to a second water management barrier, wherein at least one of the first water management barrier and the second water management barrier is the water management barrier of any of the previously described embodiments.

In yet another embodiment, a method for storing water management barriers may include providing a first water management barrier and a second water management barrier. Each of the first and second water management barriers may include a hollow body at least partially defined by a front wall, a back wall, a top portion extending between the front wall and the back wall, and a bottom portion generally opposite the top potion. The barriers may also include a foot member substantially adjacent to the bottom portion and extending outward from the back wall. The foot member may include a toe-like portion extending therefrom. The barriers may also include a plurality of channels extending along the back wall between the top portion and the toe-like portion of the foot member and one or more protrusions on the top portion exhibiting a generally rectangular geometric shape. The method may also include stacking the first water management barrier on the second water management barrier such that the one or more protrusions of the first water management barrier are positioned within one or more of the channels on the foot member of the second water management barrier and the one or more protrusions of the second water management barrier are positioned within one or more of the channels on the foot member of the first water management barrier.

This summary is provided to introduce a selection of concepts in a simplified form that are further described below in the Detailed Description. This summary is not intended to identify key features or essential features of the claimed subject matter, nor is it intended to be used as an aid in determining the scope of the claimed subject matter. Additional features of the invention will be set forth in the description which follows. The features of the invention may be realized and obtained by means of the instruments and combinations particularly pointed out in the appended claims. These and other features of the present invention will become more fully apparent from the following description and appended claims, or may be learned by the practice of the invention as set forth hereinafter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE INVENTION

Example embodiments of the invention relate to devices, systems and methods for controlling flood waters. More particularly, example embodiments relate to a water management barrier that is versatile, light-weight, cost-effective, and reusable. For instance, example embodiments of the invention provide a flood control barrier that is versatile to the contour of the landscape, allowing the water management barrier to be used on a wide variety of landscapes. Additionally, embodiments of the invention offer a light-weight water management barrier that can easily be maneuvered and assembled by one or two people. Further, embodiments of the invention provide a cost-effective system for setting up and removing a flood or other water management wall since the water management barriers can be reused, are designed for easy storage, and require significantly less labor to assemble and disassemble relative to tradition flood control barriers. The water management barriers disclosed herein may be used for managing and controlling flood waters, and "water management barrier" is thus used herein interchangeably with "flood control barrier." Such a water management barrier, or flood control barrier, may be used to manage and/or control many different types of waters, and is thus not limited to use in flood situations or with flood waters.

Figure 1:
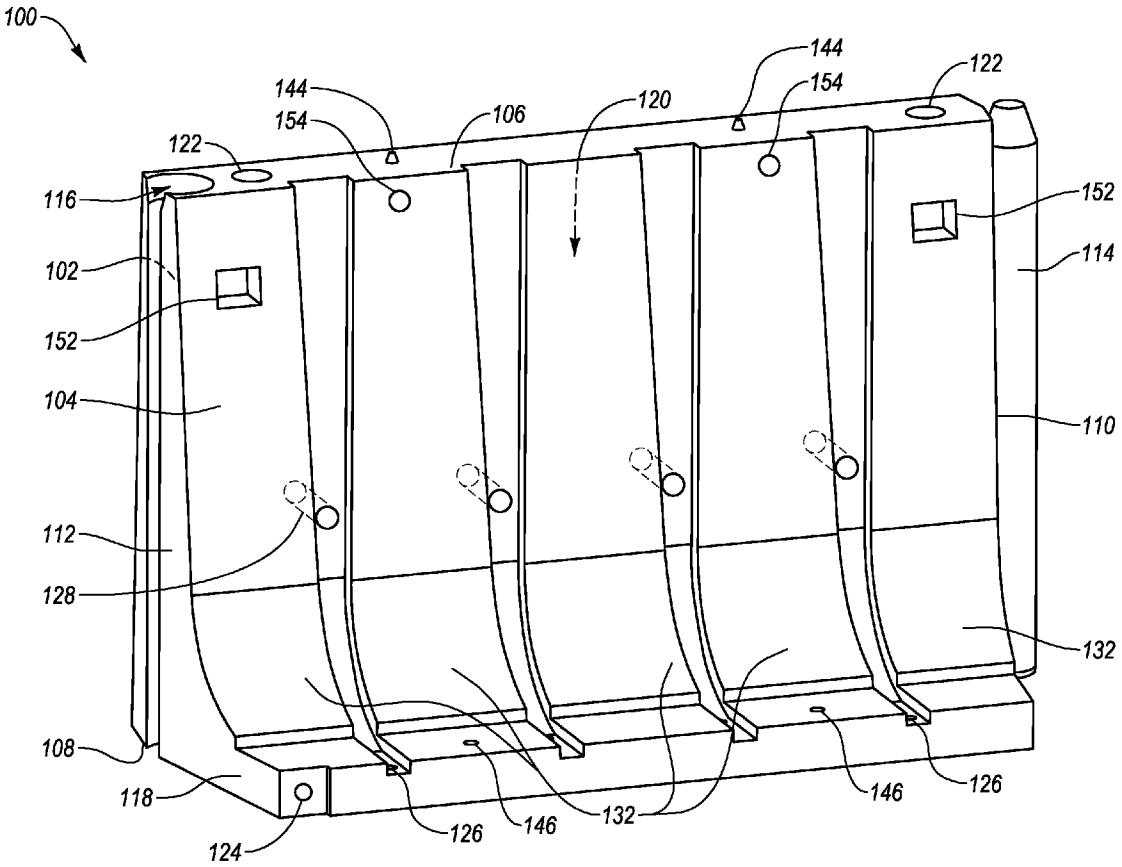
FIG. 1 illustrates a back-perspective view of an example embodiment of a water management barrier.

Generally, and as shown in FIG. 1, an example embodiment of a water management or flood control barrier 100 can have a front wall 102, a back wall 104, a top portion 106 and a bottom portion 108 that forms a substantially rigid hollow body around a hollow portion 120. Flood control barrier 100 further includes a first end 110 and a second end 112. In this embodiment, a connection member 114 is formed or otherwise attached to first end 110 and is used to connect first end 110 of the flood control barrier 100 to another flood control barrier. A connection recess 116 can also be formed in or otherwise connected to second end 112 of this embodiment, which can facilitate another flood control barrier being connected to second end 112 of flood control barrier 100. Associated with bottom portion 108 is a foot member 118. In this embodiment, and as illustrated in greater detail in FIG. 3, foot member 118 may extend outwardly from back wall 104. In some embodiments, such as that illustrated in FIGS. 1 and 3, foot member 118 may also extend generally perpendicular to back wall 104.

Flood control barrier 100 can be constructed of any number of suitable materials. For example, in one embodiment, flood control barrier 100 is constructed of light weight materials. Example light weight materials may include, for example, low-density polyethylene or other polymeric materials. When made of such materials, flood control barrier 100 can be manufactured by blow-molding, or rotational molding, and flood control barrier 100 can thus optionally have a one-piece configuration. Moreover, when flood control barrier 100 is constructed from low-density polyethylene or other similar materials, flood control barrier 100 is also reusable. Often flood waters are contaminated with oil, gas, raw sewage, or other contaminates. After exposure to such contaminates, flood control barrier 100 is easily washed clean. For this same reason, flood control barrier 100 can also be used to contain chemical spills.

While flood control barrier 100 is disclosed as being made of low-density polyethylene or other similar polymeric materials, it should be appreciated that this is merely exemplary and not limiting of the present invention. Flood control barrier 100 could be made of other materials of differing weights and densities. For instance, flood control barrier 100 could also be manufactured from metals, alloys, composites, other low-density polymers, and/or high-density polymers.

Figure 8A:
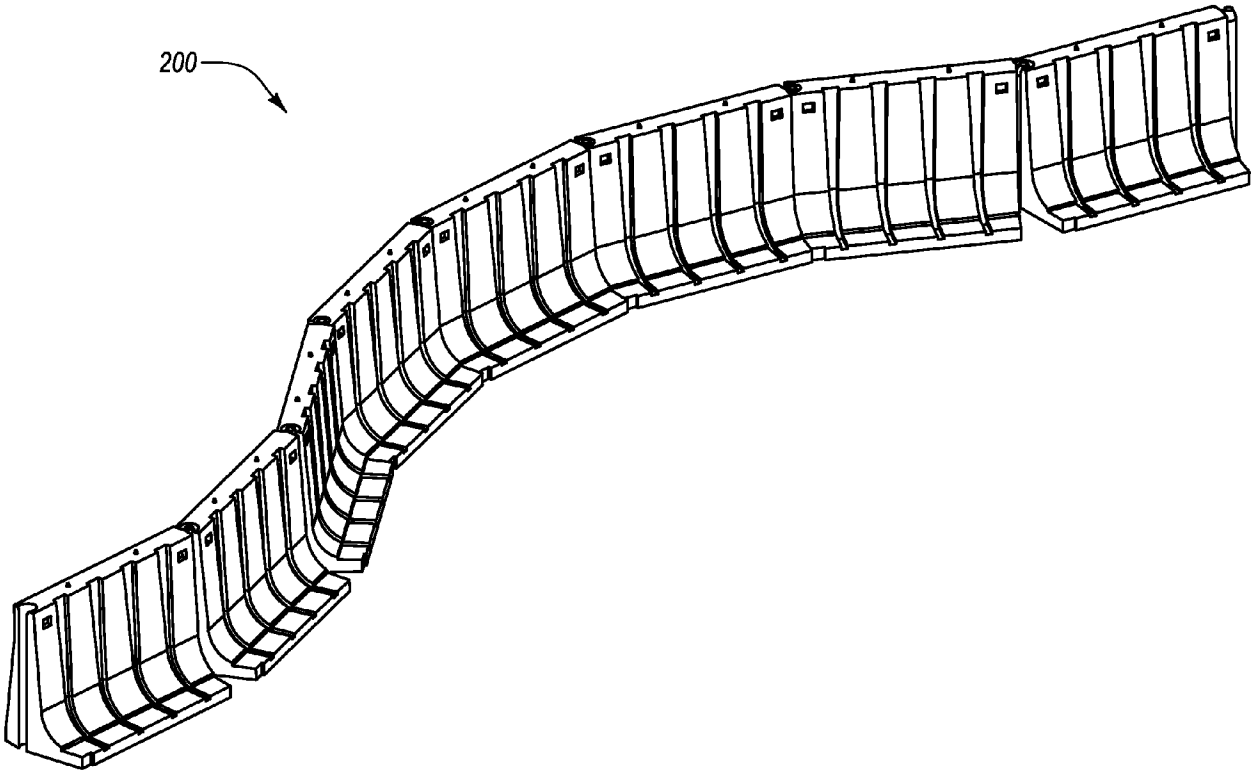
FIGS. 8A and 8B illustrate a perspective and side view of a flood wall created by several water management barriers.
Figure 8B:
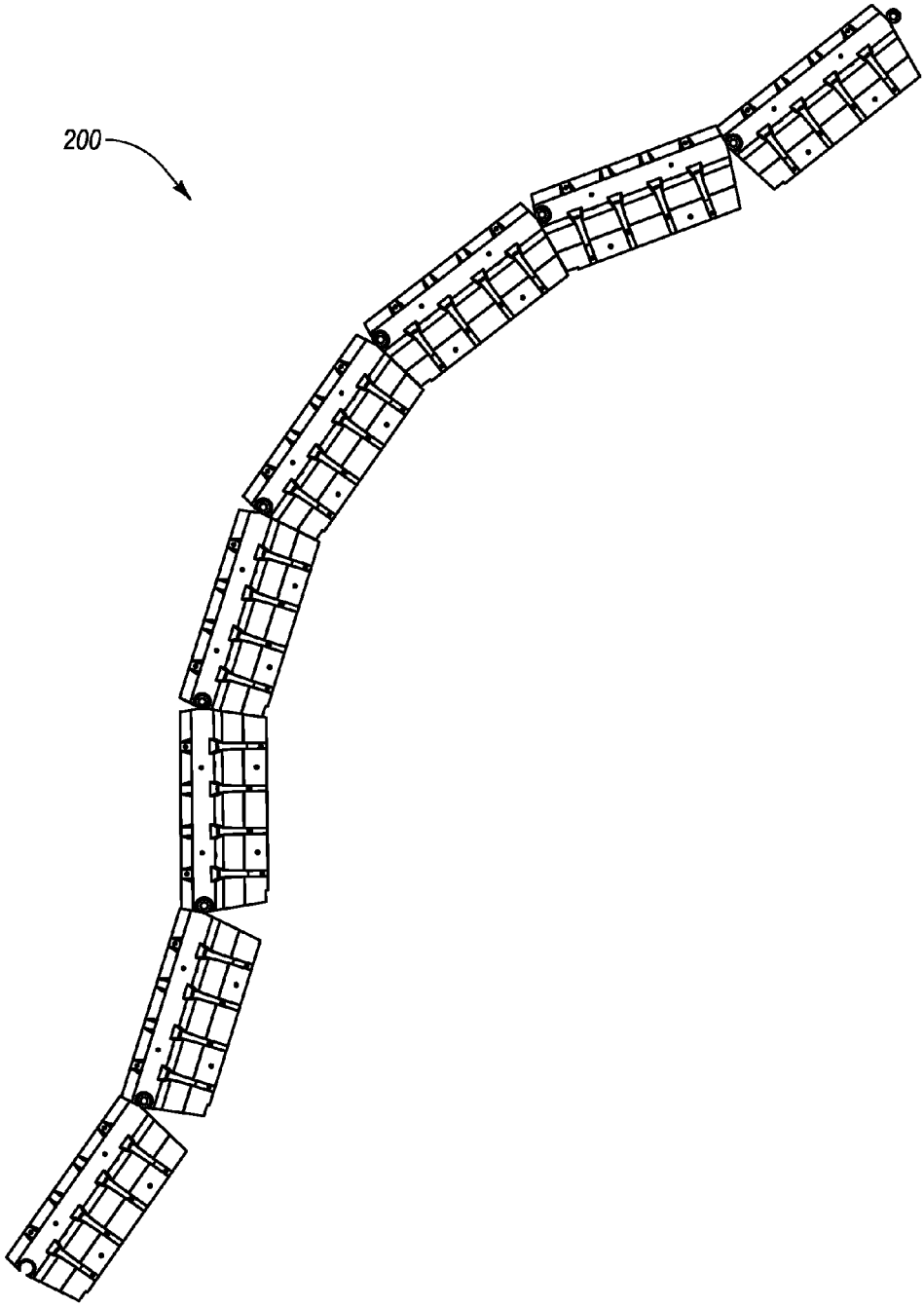

In operation, a plurality of flood control barriers 100 can be connected together to form a flood control wall 200 (see, e.g., FIGS. 8A and 8B). Additionally, flood control barrier 100 may be filled with a pourable material to provide additional weight and support to flood control wall 200. Flood control wall 200 can be assembled and positioned to divert or hold back flood water from homes, buildings, and communities in order to protect property and save lives.

Considering the structure of flood control barrier 100 in more detail, and referring to FIG. 1, front wall 102, back wall 104, top portion 106, and bottom portion 108 can form a substantially rigid hollow body that surrounds and/or substantially encloses hollow portion 120. The rigid hollow body configuration of flood control barrier 100 allows flood control barrier 100 to have a low set-up weight because of large hollow portion 120 within flood control barrier 100. For example, in one embodiment flood control barrier 100 can be about six feet long and about four feet tall while only weighing about 110 lbs., or less. Thus, flood control barrier 100 can be lifted and placed easily by two people, and possibly by even a single person.

At the same time, hollow portion 120 in the flood control barrier 100 can be filled with a pourable material. When such a pourable material is placed within flood control barrier 100, additional weight is added to flood control barrier 100 and flood control barrier 100 can then weigh upwards of about 1600 lbs., depending on the size and configuration of flood control barrier 100. For example, after flood control barrier 100 is in place, flood control barrier 100 can be filled with water. The addition of the water, for example, increases the mass of flood control barrier 100 and allows flood control barrier 100 to resist the force of flood waters in that the force of the flood water is not able to move flood control barrier 100. Therefore, flood control barrier 100 can include a set-up configuration in which flood control barrier 100 has an empty hollow portion 120, and an in-use configuration wherein hollow portion 120 is at least partially filled with a pourable material.

As mentioned, water is one example of a pourable material that may be used to fill hollow portion 120. In other embodiments, other pourable materials may be used based availability. For example, in other embodiments, a granular material such as sand, or possibly some other liquid may be poured into hollow portion 120. Multiple materials may also be mixed together. From this point on, water will be used in the following discussion; however, the pourable material or other material that is placed within hollow portion 120 not limited to water. Additionally, while the description herein describes placing a pourable material within hollow portion 120 after flood control barrier 100 is in place, this is not necessary. In some cases, hollow portion 120 may be fully or partially filled before it is moved to a final location; however, partially or fully filling hollow portion 120 will increase the weight of flood control barrier 100, and will make it more difficult to move, so in most applications hollow portion will be left unfilled before it is moved to a final location.

Flood control barrier 100 can have various optional characteristics that assist in providing an effective flood control solution as described herein. For example, hollow portion 120 of flood control barrier may have various different configurations from one embodiment to the next. As shown in FIG. 1, for example, flood control barrier 100 has a hollow portion 120 that substantially encompasses the entire flood control barrier 100, thus providing a large ratio between the set-up weight (i.e., the weight of flood control barrier 100 when not filled with water) and the in-use weight (i.e., the weight of flood control barrier 100 when filled with a water). In other embodiments, hollow portion 120 may encompass less than substantially the entire flood control barrier 100. For example, hollow portion 120 may include, in other embodiments, only the bottom half of the flood control barrier 100. Although a smaller hollow portion 120 may reduce the ratio between the set-up weight and the in-use weight, the set-up time may decrease as less time can be spent filling flood control barrier 100 with water.

In order to fill hollow portion 120 with water, flood control barrier 100 can include one or more fill ports 122. The fill ports 122 can be configured to have a cap or lid, or alternatively, fill ports 122 can simply be a hole in the top portion 106 since the water will generally remain in the hollow portion 120 even if the fill port 122 is not closed off. As illustrated in FIG. 1, fill ports 122 can be located on the top portion 106 of the flood control barrier 100. In other example embodiments, however, fill ports 122 may be located at other locations on flood control barrier 100, depending on the overall configuration of the flood control barrier 100.

Just as the location of fill ports 122 may vary from one embodiment to the next, so too can the number of fill ports 122 vary. For example, as illustrated in FIG. 1, there can be two fill ports 122 associated with flood control barrier 100. In other embodiments, there can be more or fewer fill ports 122. As will be appreciated in view of the disclosure herein, the more fill ports 122 included, the faster hollow portion 120 of flood control barrier 100 may be filled with water if all fill ports 122 are being used in adding water to flood control barrier 100.

Another way in which fill ports 122 may vary is the actual configuration of fill ports 122. For example, fill ports 122 can be configured to retain a water hose such that hollow portion 120 may be filled with water without the need for a person to physically hold the water hose during the filling process. As illustrated in FIG. 1, fill ports 122 can have a cross-sectional dimension that allows a standard size water hose to be inserted through one of fill ports 122, such that the water hose is maintained in place within hollow portion 126 of flood control barrier 100 during the filling process. In other example embodiments, fill ports 122 can be configured with a thread, clamp, or other locking or securement feature that may be used to couple the water hose to flood control barrier 100 during the filling process. Such a hose used to fill flood control barrier 100 may itself be coupled to any type of water source. For example, the hose may be connected to a secondary water supply. Additionally, or alternatively, the hose may be coupled to a pump (e.g., a trash pump) that can optionally fill and/or drain flood control barrier 100. Such a pump makes it possible to use the contained water, and can thus aid in the clean-up of flood control barriers 100 and the flood site.

As mentioned herein, once flood control barrier 100 is filled with water, flood control barrier 100 can weigh upwards of about 1600 lbs. When flood control barrier 100 is no longer needed, it may be desirable to move flood control barrier 100. At such time, while flood control barrier 100 may be moved with the water therein, it may be desirable to drain the water from hollow portion 120 so flood control barrier 100 can once again be easily moved by one or more two people. Therefore, flood control barrier 100 can include one or more drain ports 124. As illustrated in FIG. 1, a drain port 124 is located on foot member 118 on the back wall side of flood control barrier 100. The location of the drain port 124 can, however, be located in any suitable location, and need not be positioned only on foot member 118. For example, drain port 124 can be positioned anywhere near or on bottom portion 108 or foot member 118 of flood control barrier 100. For example, drain port 124 may be located on the front wall side of flood control barrier 100. In still other embodiments, fill ports 122 may also act as drain ports. For instance, if flood control barrier 100 is tipped over when full or after partially draining hollow portion 120, water can also exit out of fill ports 122. In other embodiments, a siphon hose or pump can be inserted through fill ports 122 and/or drain ports 124 to facilitate draining of hollow portion 120. For example, if a pump is used to fill barrier 100, the same pump may also be used to pump out the fluid within barrier 100 when the flood or managed site is being cleaned-up and the flood management system is being removed.

Just as the location of drain port 124 may vary, so too can the number of drain ports 124 vary. As shown in FIG. 1, flood control barrier 100 includes a single drain port 124. Other example embodiments may include several drain ports 124 such that the water may be drained more quickly out of hollow portion 120 of flood control barrier 100. Moreover, one example embodiment provides at least two drain ports 124, one drain port 124 located on the front wall side, and one drain port 124 located on the back wall side of flood control barrier 100, such that the water may drain out the front wall side, the back wall side, or both, depending on the most convenient direction to release the water.

Drain port 124 may be configured to retain the water within hollow portion 120 until flood control barrier 100 is no longer needed. In one example embodiment, drain port 124 includes a drain cap (not shown) that is associated with drain port 124 such that the drain cap can effectively close the drain port 124. The drain cap may include a seal that cooperates with drain port 124 and the drain cap to form a water-tight seal. The drain cap can have a threaded, interference fit, or other retention or securement mechanism relative to drain port 124 such that the drain cap can easily be used to close or open drain port 124. Moreover, a retention means, such as a chord, may be connected to both the drain cap and flood control barrier 100 so that the drain cap does not get lost if removed from drain port 124.

Figure 3:
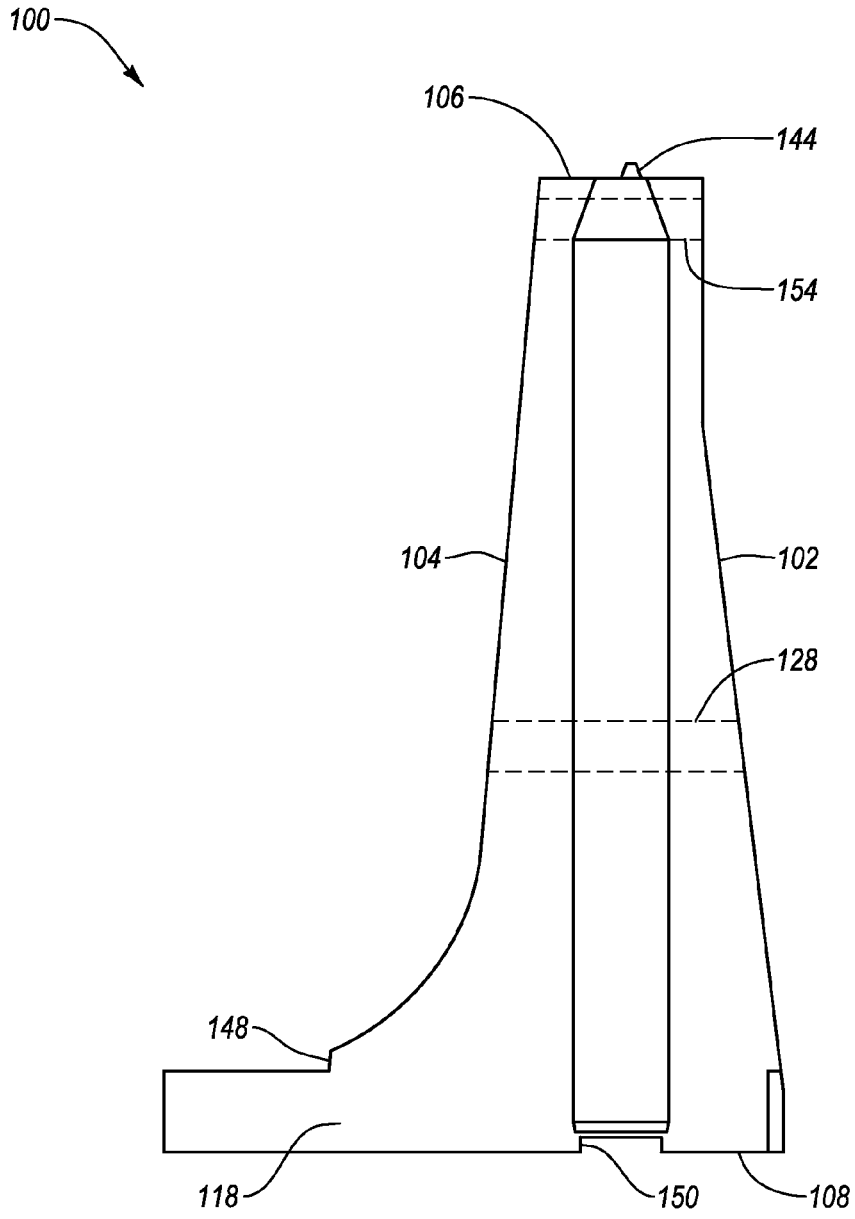
FIG. 3 illustrates a side view of an example embodiment of a water management barrier.

In addition to fill ports 122 and drain port 124, various other optional characteristics of flood control barrier 100 can assist with providing an effective flood control barrier. For example, flood control barrier 100 can have a variety of geometric configurations that stabilize and provide strength to the overall structure of flood control barrier 100. For instance, and as best illustrated in FIG. 3, top portion 106 can have a width that is narrower than the width of bottom portion 108. Having bottom portion 108 wider than top portion 106, while optional, can provide flood control barrier 100 with added stability.

Figure 2:
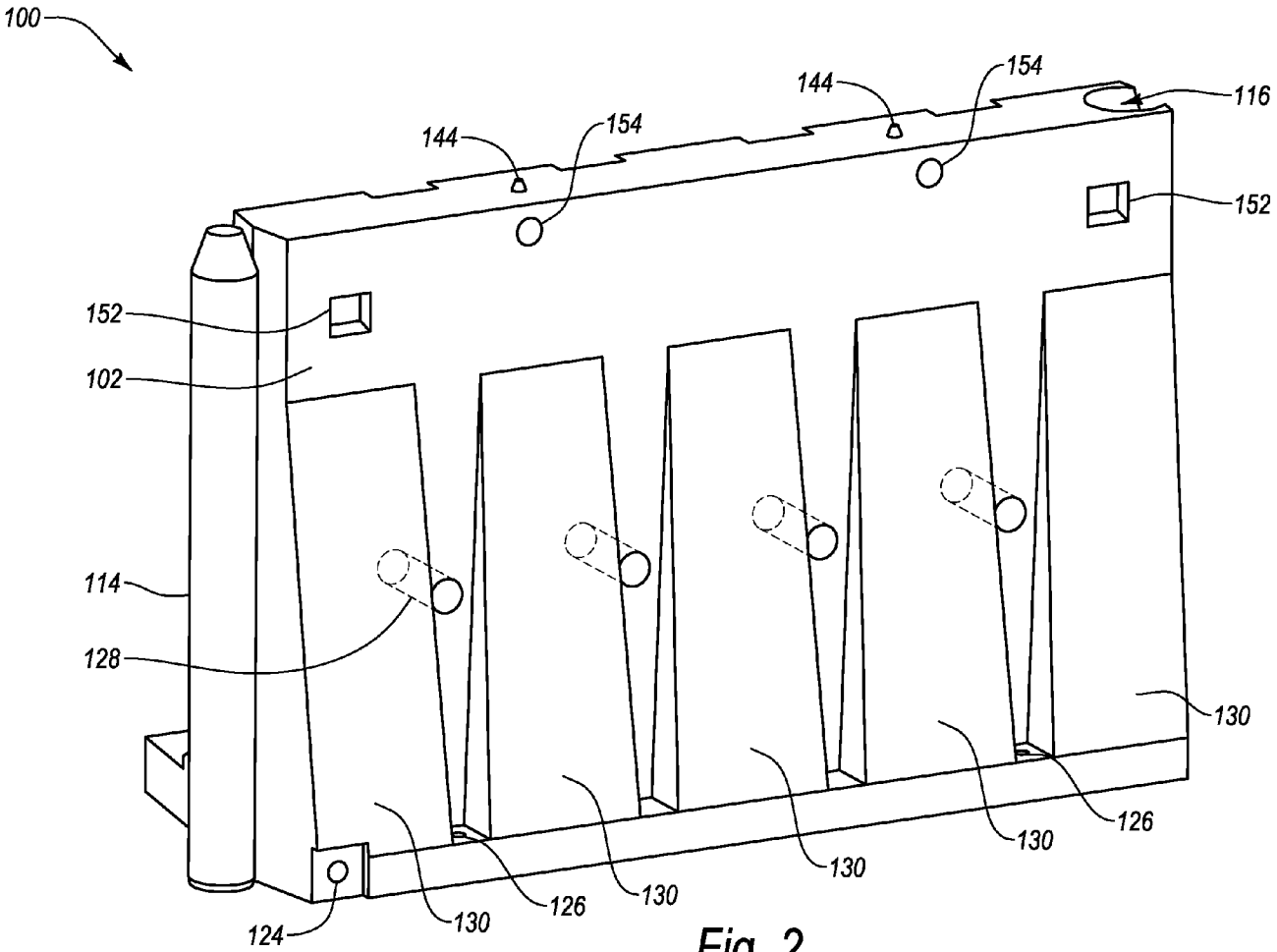
FIG. 2 illustrates a front-perspective view of an example embodiment of a water management barrier.

Moreover, foot member 118 can provide addition stability as well as strength. As illustrated in FIGS. 1 through 3, foot member 118 can extend outward from back wall 104, thereby providing a large base for flood control barrier 100. In one example embodiment, the overall width of the bottom of flood control barrier 100, including bottom portion 108 and foot member 118, is between about twenty-four inches to about thirty-six inches. When compared to the width of top portion 106, which may be between about three inches and about ten inches, the width of the bottom of flood control barrier 100 provides a stable base. For example, in one embodiment, the width of the bottom of flood control barrier 100 is about thirty-one inches and the width of top portion 106 is about eight 8 inches. The foregoing dimensions are merely exemplary, and in other embodiments, the width of the bottom of flood control barrier 100 may be larger than thirty-six inches, or less than twenty-four inches in other embodiments and the width of top portion 106 may be larger than six inches or less than three inches. It is also not necessary that such relative proportions of top-to-bottom dimensions be maintained.

As will be appreciated by one skilled in the art in view of the disclosure herein, foot member 118 may not only add stability to flood control barrier 100, but may also provide flood control barrier 100 with added strength to resist the force of flood waters. In particular, when in use, flood water creates pressure that results in a force that acts normal to the surface area of a submerged member. As a result, as foot member 118 is positioned below the surface of flood water, the flood water provides a downward force acting normal to foot member 118, and that helps hold flood control barrier 100 in place, thereby increasing the ability of flood control barrier 100 to contain flood water.

Another way in which flood control barrier 100 can be strengthened is through the use of stake ports 126. As illustrated in FIGS. 1 through 2, stake ports 126 may be positioned at one or more of various locations on bottom portion 108 and/or foot member 118 of flood control barrier 100. As shown, stake ports 126 can generally be configured to provide a port that extends through bottom portion 108 and/or through foot member 118, so as to permit a stake, post, rod, spike, or other similar device, to be inserted through stake port 126 and extend into the ground or other surface therebelow.

Figure 4:
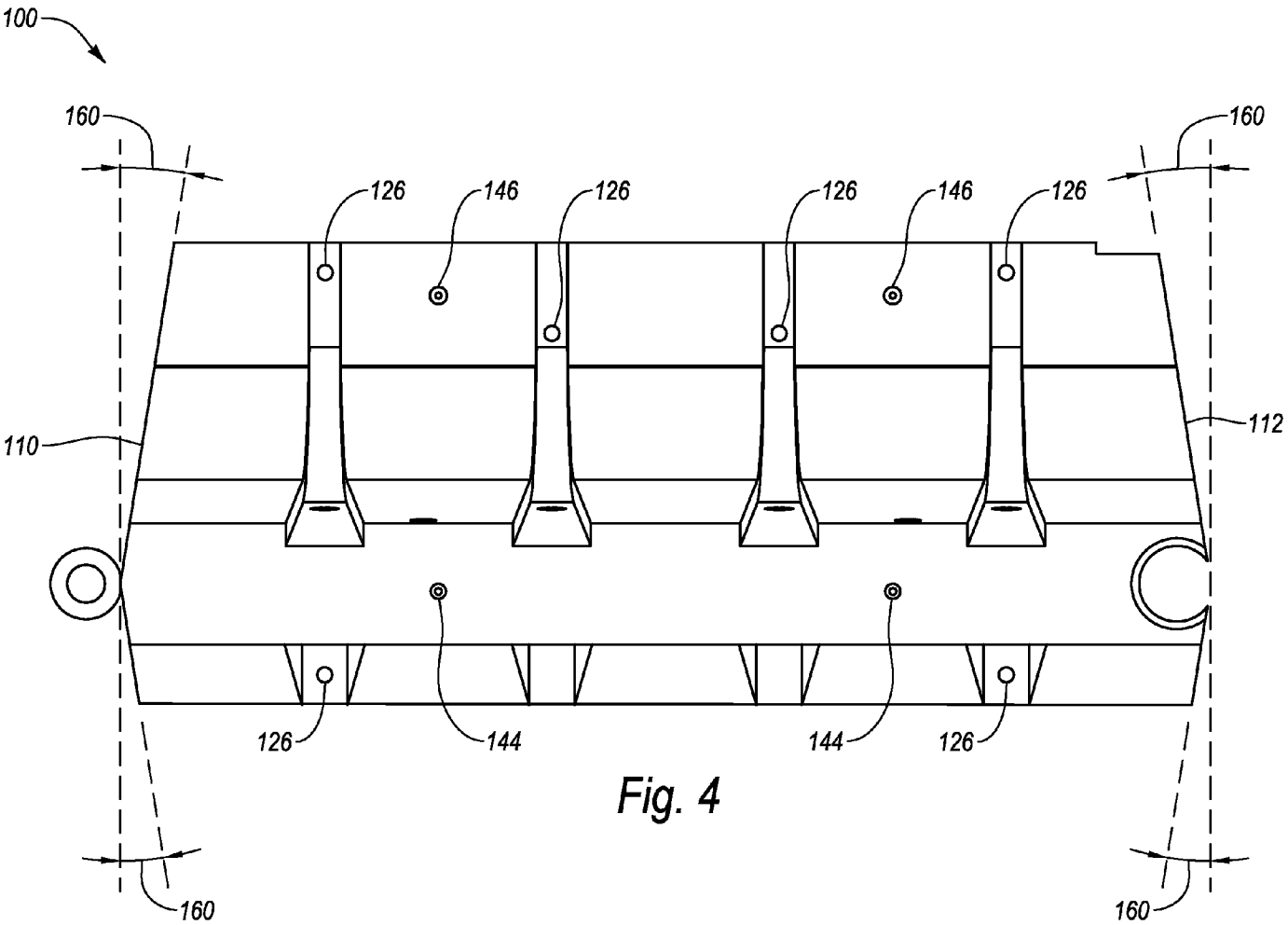
FIG. 4 illustrates a top view of an example embodiment of a water management barrier.

The number of stake ports 126 included within the flood control barrier 100, if any, may vary from one embodiment to the next. In one example, as illustrated in FIG. 4, flood control barrier 100 can include six stake ports 126. In other embodiments, more or fewer stake ports 126 may be included with flood control barrier 100, and the number of stake ports 126 may vary depending on the overall size and/or configuration of flood control barrier 100. Moreover, the position of stake ports 126 on flood control barrier 100 may vary depending on the size, shape, or other configuration of flood control barrier 100.

Stake ports 126 can provide additional strength to flood control barrier 100, particularly with respect to its resistance to move from a predetermined location on the ground; however, flood control barrier 100 also can include various features that provide structural integrity relative to flood control barrier 100 itself. For example, as shown in FIGS. 1-3, flood control barrier 100 can include one or more support rods 128. In the illustrated example embodiment, support rods 128 are positioned between front wall 102 and back wall 104. Such support rods 128 can provide structural integrity to flood control barrier 100. For instance, as noted above, flood water may exert a pressure force normal to a submerged surface. Such flood water may, therefore, exert a force normal to back wall 104, which would tend to try to cause back wall 104 to collapse inward and towards front wall 102. Support rods 128 can, however, resist such a force placed on flood control barrier 100 due to the flood water. In one example, and as shown in FIGS. 1 and 2, flood control barrier 100 can include four support rods 128 that extend from front wall 102, through hollow portion 120, to back wall 104. With this configuration, support rods 128 help ensure that the structure of flood control barrier 100 remains solid and avoids failure, such as a collapse of back wall 104 into hollow portion 120.

The configuration of support rods 128, if any, can vary from one embodiment to the next. For example, the position of support rods 128 can vary. As illustrated in FIG. 1, support rods 128 can be substantially aligned in a horizontal row and be substantially equally spaced apart one from another. In other embodiments, support rods 128 may be offset one from another and/or have unequal distances between one support rod 128 to the next. In some embodiments, support rods 128 may be horizontally and vertically offset such that there are multiple rows of support rods 128.

In addition to variations in the position of support rods 128, the shape and dimensions of support rods 128 may vary. In one example embodiment, the cross-sectional dimension of support rods 128 is about one inch to about two inches. In other example embodiments, the cross-sectional dimension of support rods 128 may be larger than about two inches, or smaller than about one inch, depending on the desired configuration of flood control barrier 100. Moreover, support rods 128 as illustrated in FIG. 1 have a substantially cylindrical configuration. In other example embodiments, however, support rods 128 may have various other configurations. For example, support rods 128 may have a cross-sectional shape that is rectangular, square, elliptical, or has some other shape. Moreover, while support rods 128 are shown as elongated, this is not necessarily the case as the dimensions of support rods 128 may vary.

Depending on the configuration of flood control barrier 100, the number of support rods 128 included in flood control barrier 100 may vary. For example, and as illustrated in FIG. 1, flood control barrier 100 can have four support rods 128. In other example embodiments, flood control barrier 100 can have more or fewer support rods 128 depending on the overall configuration of the flood control barrier 100. For example, in one embodiment, flood control barrier 100 may have no support rods 128, may have eight support rods 128, or may have more or fewer than eight support rods 128.

Support rods 128 are only one example of how the structural integrity of flood control barrier 100 can be improved. Another example is the geometric configuration of front wall 102 and back wall 104. In particular, and as illustrated in FIG. 2, front wall 102 can include a series of raised portions 130. As will be appreciated in view of the disclosure herein, raised portions 130 can provide additional structural strength to flood control barrier 100 because the sides of raised portions 130 may act as a type of truss that supports front wall 102, such that front wall 102 further resists bending when placed under the forces of flood water. Similarly, and as shown in FIG. 1, back wall 104 can include raised portions 132. In the same way that raised portions 130 at or on front wall 102 provide additional structural strength to flood control barrier 100, raised portions 132 positioned at or on back wall 104 can provide strength to flood control barrier 100.

Raised portions 130 and 132 may vary from one embodiment to the next. For example, the number of raised portions 130 and 132 can vary. As illustrated, both front wall 102 and back wall 104 include five raised portions 130 and 132, respectively. In other example embodiments, front wall 102 and/or back wall 104 can include more or fewer raised portions 130 and 132, respectively, depending on the configuration of flood control barrier 100.

In addition to the number of raised portions 130 and 132, the geometric configuration of raised portions 130 and 132 may vary from one embodiment to the next. For example, the width, length, and height (i.e., the extent to which raised portions 130 and 132 project from front wall 102 and back wall 104, respectively) may vary from one embodiment of flood control barrier 100 to the next, from one raised portion 130 or 132 to the next, or within the same raised portion 130 or 132.

Just as there are various geometric characteristics that provided added strength and support to flood control barrier 100, there are other geometric characteristics that can provide a unique and effective way to store the flood control barrier 100. By way of illustration, flood control barrier 100 can have geometric features that provide for easy stacking and/or storage of flood control barriers 100 when not in use. For example, and as illustrated in FIG. 1, flood control barrier 100 can include protrusions 144 that project from top portion 106, and corresponding indentations 146 that are formed on the top surface of foot member 118. Of course, the size, configuration, and position of protrusions 144 and indentations 146 can vary from one embodiment to the next.

Figure 5A:
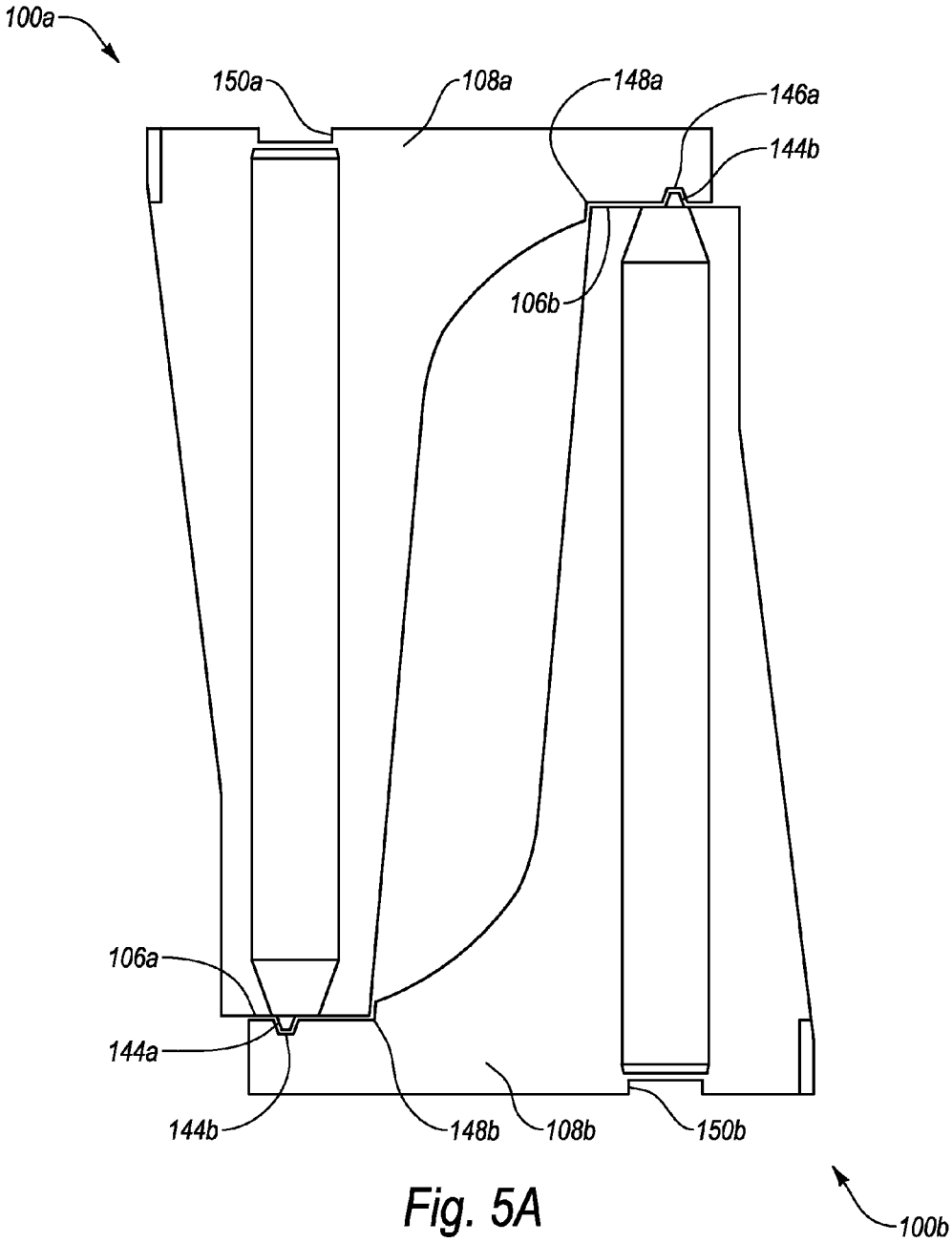
FIG. 5A illustrates a side view of example water management barriers in a storage configuration.

In more detail, and as shown in FIG. 5, protrusions 144*a* of a first flood control barrier 100*a* are configured to be able to fit within indentations 146*b* of a second flood control barrier 100*b*. Furthermore, protrusions 144*b* of second flood control barrier 100*b* are configured to fit within indentations 146*b* of first flood control barrier 100*a*. Therefore, first flood control barrier 100*a* can be stacked in a compact storage configuration next to second flood control barrier 100*b*, as illustrated in FIG. 5. Moreover, protrusions 144 and indentations 146 allow the stacked flood control barriers 100*a*, 100*b* to be stable while in a stacked configuration.

In addition to protrusions 144 and indentations 146, flood control barrier 100 can optionally include a storage lip 148, as illustrated in FIG. 3. In one example embodiment, storage lip 148 is configured such that top portion 106 of another flood control barrier 100 cooperates with storage lip 148 for secure and compact storage. For example, as illustrated in FIG. 5, first flood control barrier 100*a* includes a storage lip 148*a*. Top portion 106*b* of second flood control barrier 100*b* interacts with the storage lip 148*a* such that first flood control barrier 100*a* and second flood control barrier 100*b* are in a more stable and compact storage configuration. Similarly, top portion 106*a* of second flood control barrier 100*a* interacts with storage lip 148*b* on second flood control barrier 100*b*.

Figure 5B:
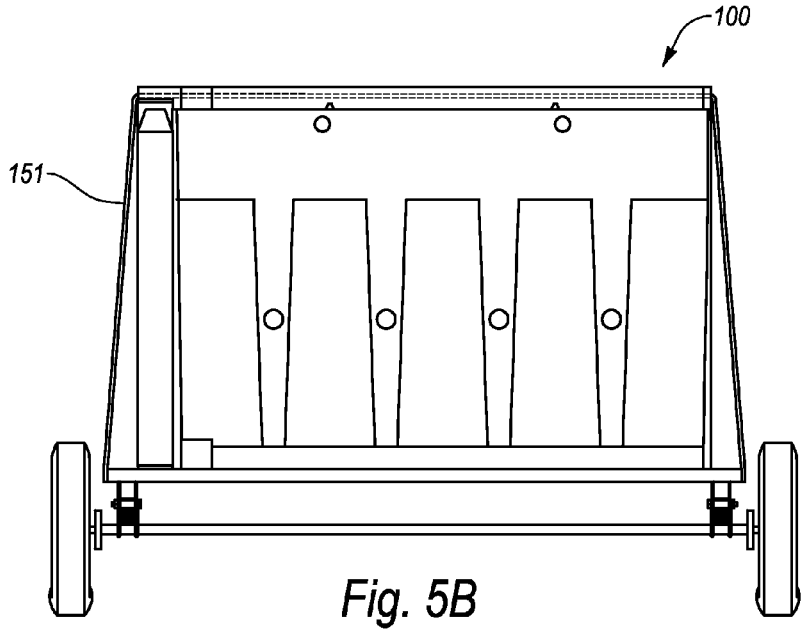
FIGS. 5B through 5C illustrate a front and side view of water management barriers in a storage configuration loaded on a transport vehicle.
Figure 5C:
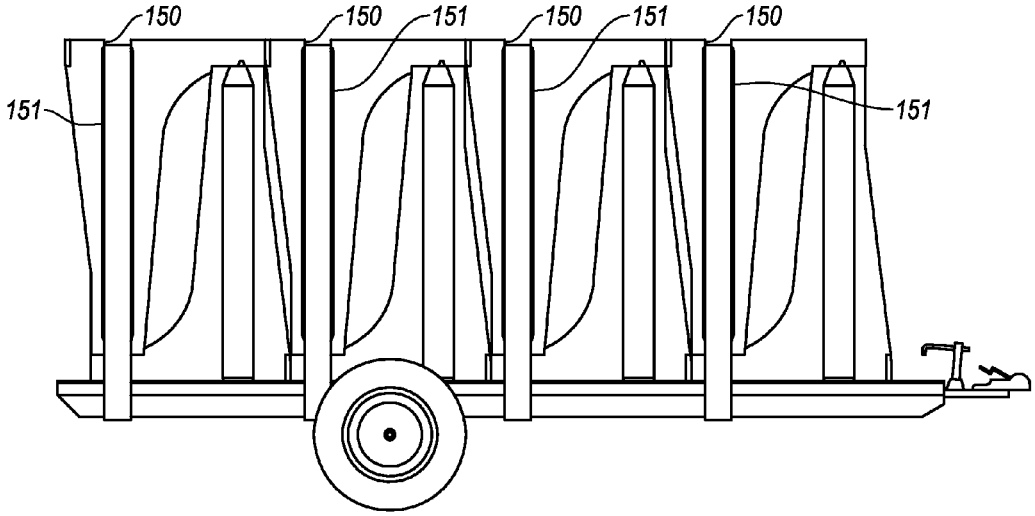

Once the flood control barriers are in the storage configuration, an example of which is illustrated in FIG. 5, the flood control barriers in the storage configuration may be stacked tightly together, and stacked in multiple layers, as illustrated in FIG. 5C. FIG. 5C illustrates multiple flood control barriers stacked in horizontal layers, although one skilled in the art will appreciate in view of the disclosure herein that flood control barriers may also be stacked in multiple vertical layers.

In one example, flood control barriers that are positioned in the storage configuration can be stacked on a flat bed trailer such that the flood control barriers can quickly be transported to a flood zone if needed. In one example embodiment, a forty-foot trailer can hold up to seventy-two individual flood control barriers 100. In other embodiments, a trailer can carry more or fewer flood control barriers 100 depending on the size of flood control barriers 100 and the size of the trailer.

Furthermore, flood control barriers 100 may be secured to a trailer or other movable storage location. In one example embodiment, a strap system may be used to secure flood control barriers 100 in the storage configuration. Flood control barriers 100 can, for example, include a strap groove 150 that offers a location for a strap 151 to interface with flood control barriers 100, such that strap 151 can securely hold the flood control barriers on a trailer or other device. In one example, and as illustrated in FIG. 3, strap groove 150 is located in a distal surface of bottom portion 108 of flood control barrier 100.

Referring now to FIGS. 5B and 5C, one can more fully appreciate how a strap 151 can be used in combination with a strap groove 150 to secure flood control barriers 100 on a trailer when flood control barriers 100 are in the storage configuration. In the illustrated embodiment, the storage configuration of flood control barriers places bottom portion 108 of a flood control barrier 100 at an upright position, and upward relative to a surface of the trailer. Because bottom portion 108 is vertically offset from the trailer, a strap 151 is able to interact with strap groove 150. Strap 151 can then be coupled to the trailer and tightened around the flood control barriers 100 to hold them securely in place during transport.

In one example embodiment, flood control barriers 100 are first strapped to carts and then loaded onto a trailer such that flood control barriers 100 may be removed from the trailer with additional efficiency. The carts may be customized to lock into place on the trailer during transport, and easily unlock from the trailer when removed. Additionally, the carts, whether standard or customized, may hold up to twelve flood control barriers 100 or more and may be moved to a central deployment location so that the flood control barriers 100 may be assembled into a flood wall 200. Depending on the configuration of the trailer, carts, and/or flood control barriers 100, more or fewer flood control barriers 100 may be placed on any single cart or trailer.

Figure 6A:
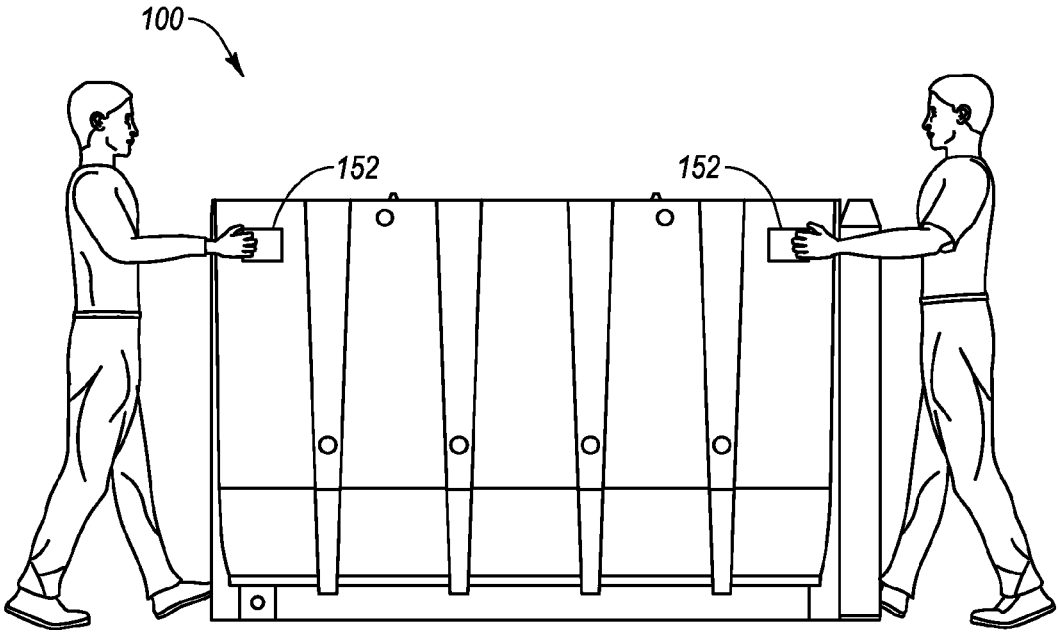
FIGS. 6A through 6B illustrate example water management barriers with features used to carry the water management barrier.

As mentioned earlier, the unique configuration of flood control barrier 100 with hollow portion 120 allows flood control barrier 100 to have a manageable weight that allows it to be moved by one or two people. For example, with a weight of less than about 110 pounds, two people could easily move flood control barrier 100 into an assembly position. A single person may also be able to move flood control barrier 100 into an assembly position, particularly if a dolly or other device is used. In addition to the lightweight configuration, flood control barrier 100 also can additionally, or alternatively, incorporate other features that allow people to easily maneuver, position, and secure flood control barrier 100. For instance, in one embodiment, flood control barrier 100 can include integral handles 152. For example, and as illustrated in FIGS. 1 through 2, a combination of four integral handles 152 can be positioned on front wall 102 and back wall 104, and optionally near first end 110 and second end 112, so as to provide easily accessible grips usable by two people holding flood control barrier 100 from each end, as illustrated in FIG. 6A.

The integral handles 152, illustrated in FIGS. 1 and 2, are rectangular recesses in front wall 102 and back wall 104. In alternative embodiments, however, integral handles 152 can protrude from front wall 102 and/or back wall 104. Various other configurations of integral handles 152 are possible depending on the overall size and configuration of the flood control barrier 100, as at least the size, shape, and location of integral handles 152 can be varied. In other embodiments, handles may not be integral at all times. For example, recesses may be formed with selectable lock-fit capability, so that handles can be selectively secured to flood control barrier 100 when needed, and then released when not necessary.

Figure 6B:
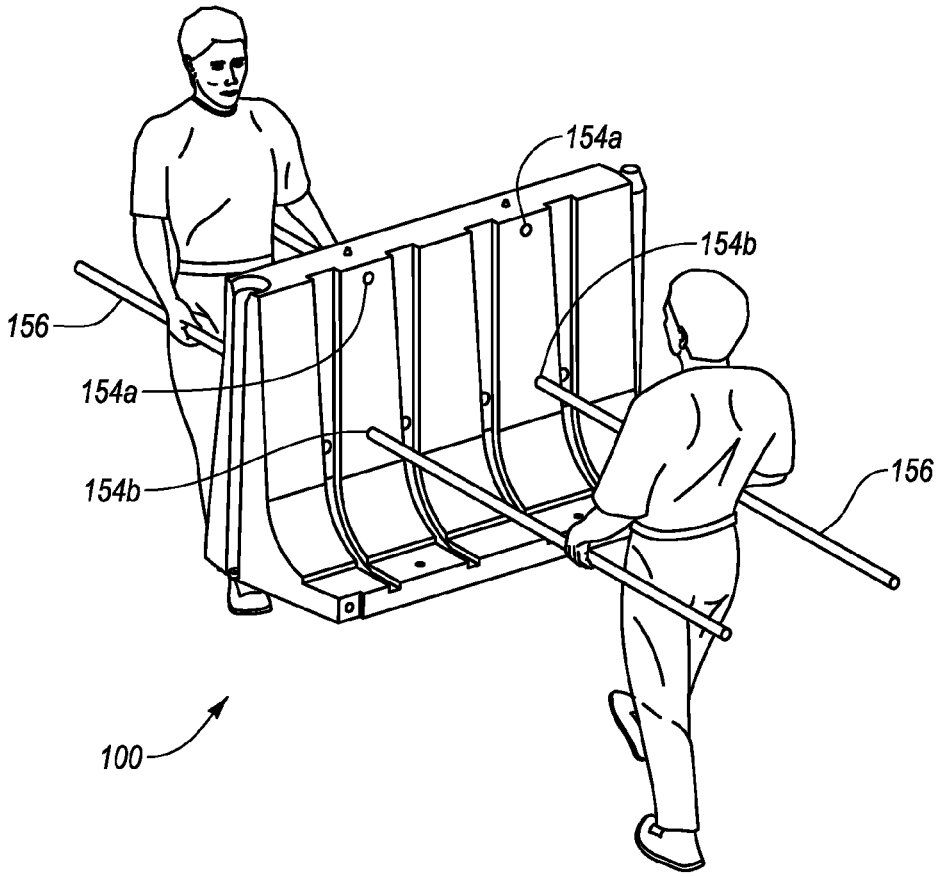

In addition to integral handles 152, the flood control barrier 100 can optionally include upper lifting pole ports 154*a* and/ or lower lifting pole ports 154*b* through which lifting poles 156 can be inserted. For example, the lifting poles 156 can be inserted through the lower lifting pole ports 154*b*, as illustrated in FIG. 6B. Lifting poles 156 can then be used by one or two people to easily lift and position flood control barrier 100 in the desired location and position. The lower lifting poles ports 154*b* also provide an effective and efficient way for two people to lift the flood control barrier 100 higher above the surface of the ground. This can be especially helpful when assembling a flood control wall 200, as will be described further hereafter.

Referring back to FIGS. 1 through 4, connection member 114 and connection recess 116 will be discussed in more detail in order to demonstrate how flood control barriers 100 may be assembled to form a flood control wall 200 such as that illustrated in FIG. 8A. In one example, connection member 114 and connection recess can be molded or otherwise formed as part of flood control barrier 100. As such, multiple barriers may be connected together to form a flood control wall without requiring any additional components. In other embodiments, however, it may be desirable to form connection member 114 and/or connection recess 116 separate from flood control barrier 100.

In one example embodiment, connection member 114 is a substantially cylindrical member, such as that illustrated in FIGS. 1 through 4. Connection recess 116 can have a corresponding shape and configuration and, as a result, in FIGS. 1 through 4, may also have a cylindrical configuration such that connection member 114 of one flood control barrier can interface with connection recess 116 of another flood control barrier to couple the two flood control barriers together and form a flood control wall. Connection member 114 may be designed to have the same general dimensions as connection recess 116. Therefore, when connection member 114 of one flood control barrier 100 is inserted into connection recess 116 of another flood control barrier 100, a substantially tight seal may be created, thus preventing or substantially limiting flood water from escaping between the flood control barriers.

Connection member 114 can have various additional or alternative characteristics that assist in connecting one flood control barrier 100 to another. For example, and as illustrated best in FIG. 2, connection member 114 can include a tapered end 158. Tapered end 158 can have a conical shape, as shown in FIG. 2, or any other shape that reduces the cross-sectional dimension of the connection member 114 near the top of connection member 114. This reduction in the cross-sectional dimension of the connection member 114 near the top of connection member 114 allows for a smooth initial interface with connection recess 116 of an adjacently placed flood control barrier 100, such that connection member 114 does not have to be perfectly aligned with connection recess 116 in order to be connected together.

In addition to tapered end 158, connection member 114 can have various other geometric characteristics. In one example embodiment, such as that illustrated in FIG. 2, connection member 114 has a substantially constant cross-sectional dimension from top to bottom, not including tapered end 158. For instance, the connection member 114 can have a cylindrical configuration, as illustrated in FIG. 2. The cylindrical configuration can allow adjacent flood control barriers 100 to be securely assembled even when the ground is not flat (e.g., adjacent flood control barriers 100 can be assembled when the elevation of the supporting ground changes). In addition, the cylindrical configuration of the connection member 114 can allow the flood control barriers to be assembled in two directions because the cross-section dimension of the connection member 114 is substantially constant from top to bottom.

In an alternative embodiment, connection member 114 can have a conical configuration having its base oriented at the bottom of flood control barrier 100 and extending upward towards the top of flood control barrier 100. The radius of the cone shape can decrease gradually as the cone extends towards the top of the barrier. In other embodiments, a conical configuration may be provided in which the connection member tapers such that the radius of the cone decreases gradually as the cone extends towards the bottom of the barrier.

Figure 7A:
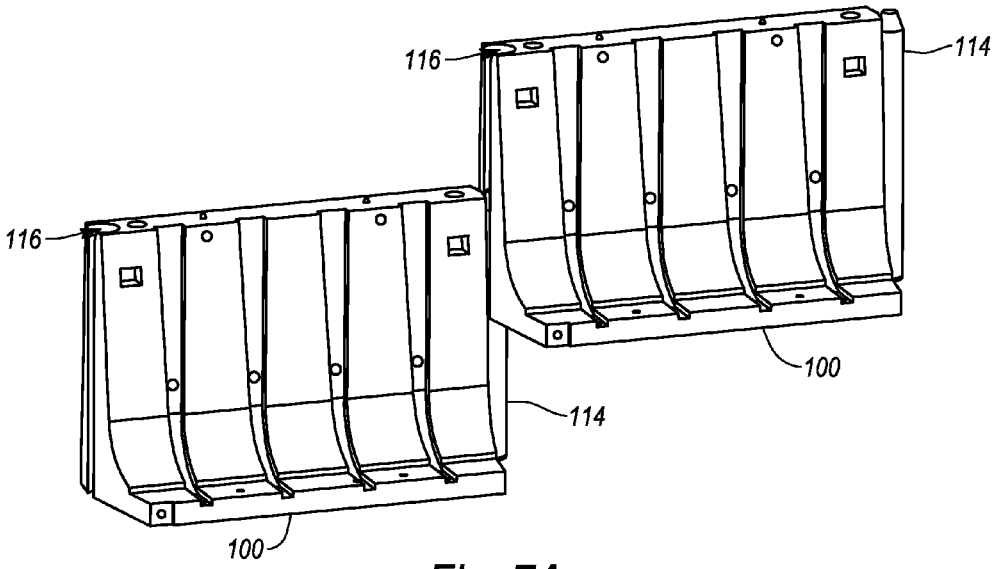
FIGS. 7A and 7B illustrate an example connection system between two water management barriers.
Figure 7B:
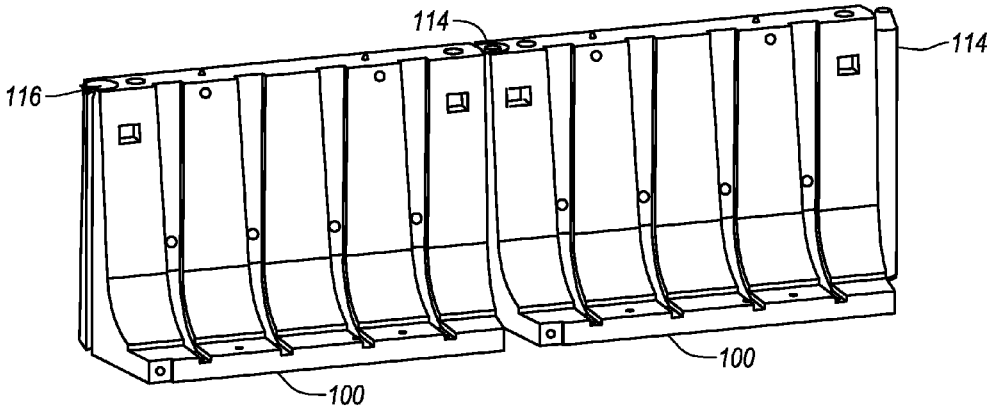

Cone shaped connection members can simplify assembly of the flood control inasmuch as to connect one flood control barrier 100 to another, flood control barrier 100 needs to be lifted only to a fraction of the height of the other barrier, such as twelve inches for example, before it can be dropped into place. This is so because the width of the opening of connection recess 116 may be greater than the width of connection member 114 at a height less than the full height of the flood control barrier 100, as illustrated in FIGS. 7A through 7B. Conical connection members is, however, only one possible configuration and many other types of interlocking or other connection members may be used in connection with flood control barrier 100.

Once flood control barriers 100 are connected, flood control wall 200 can be constructed. An example of flood control wall 200 is shown in FIGS. 8A through 8B. Flood control wall 200 can be assembled such that flood control wall 200 forms curves as necessary to control flood waters in a particular geography. For example, FIG. 8A illustrates a perspective view of an example flood control wall 200 that has an S-shaped configuration. FIG. 8B illustrates another example embodiment where the flood control barriers 100 are arranged to form an S-shaped configuration, although other straight and curved configurations are possible. Other example flood control walls 200 may have various other configurations depending on the geography and terrain where flood control wall 200 is used.

As is shown in FIGS. 8A and 8B, flood control barriers 100 are configured to be able to be rotated with respect to an adjacent flood control barrier while connected. Due to the cylindrical and/or conical shape of connection member 114 and the corresponding shape of connection recess 116, flood control barriers 100 may be rotated with respect to one another. Additionally, and referring to FIG. 4, first end 110 and second end 112 of flood control barrier 100 can be angled away from connection member 114 and connection recess 116, respectively. This configuration produces an angle 160 that allows the flood control barrier 100 to be rotated with respect to an adjacent flood control barrier 100 while remaining connected thereto. In one example embodiment, flood control barrier 100 can be rotated up to about twenty-five degrees relative to an adjacent flood control barrier 100, depending on the overall configuration of the flood control barrier 100. This allows the flood control wall 200, as shown in FIG. 8B, to be assembled to follow meandering water-ways or streets or other terrain that requires flood control wall 200 to bend and curve. Of course, flood control barriers 100 may also be configured to rotate relative to each other in amounts greater than about twenty-five degrees, or may have a maximum rotation of less than about twenty-five degrees (e.g., about fifteen degrees).

Figure 9A:
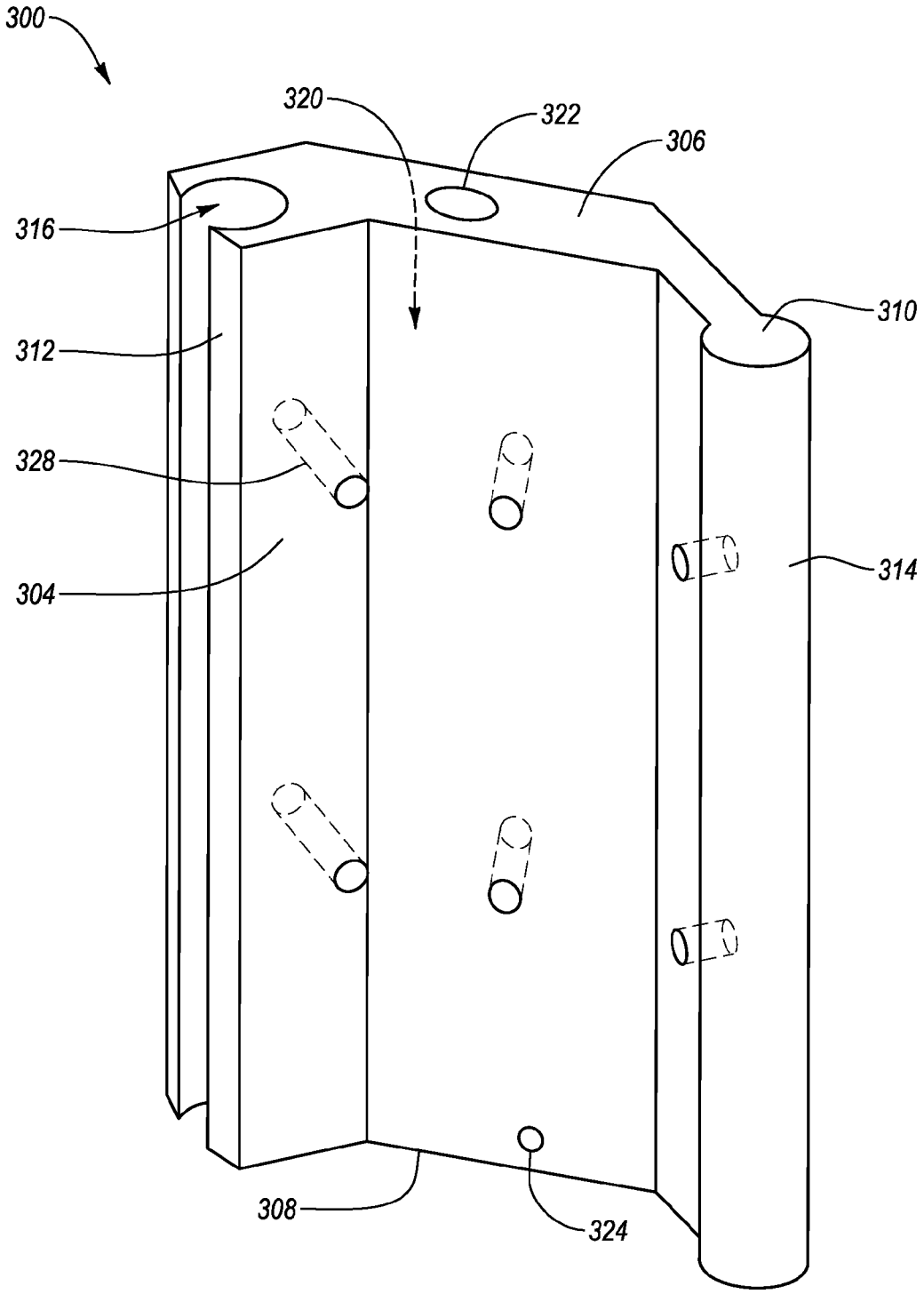
FIG. 9A illustrates a back view of an example embodiment of a corner barrier.
Figure 9B:
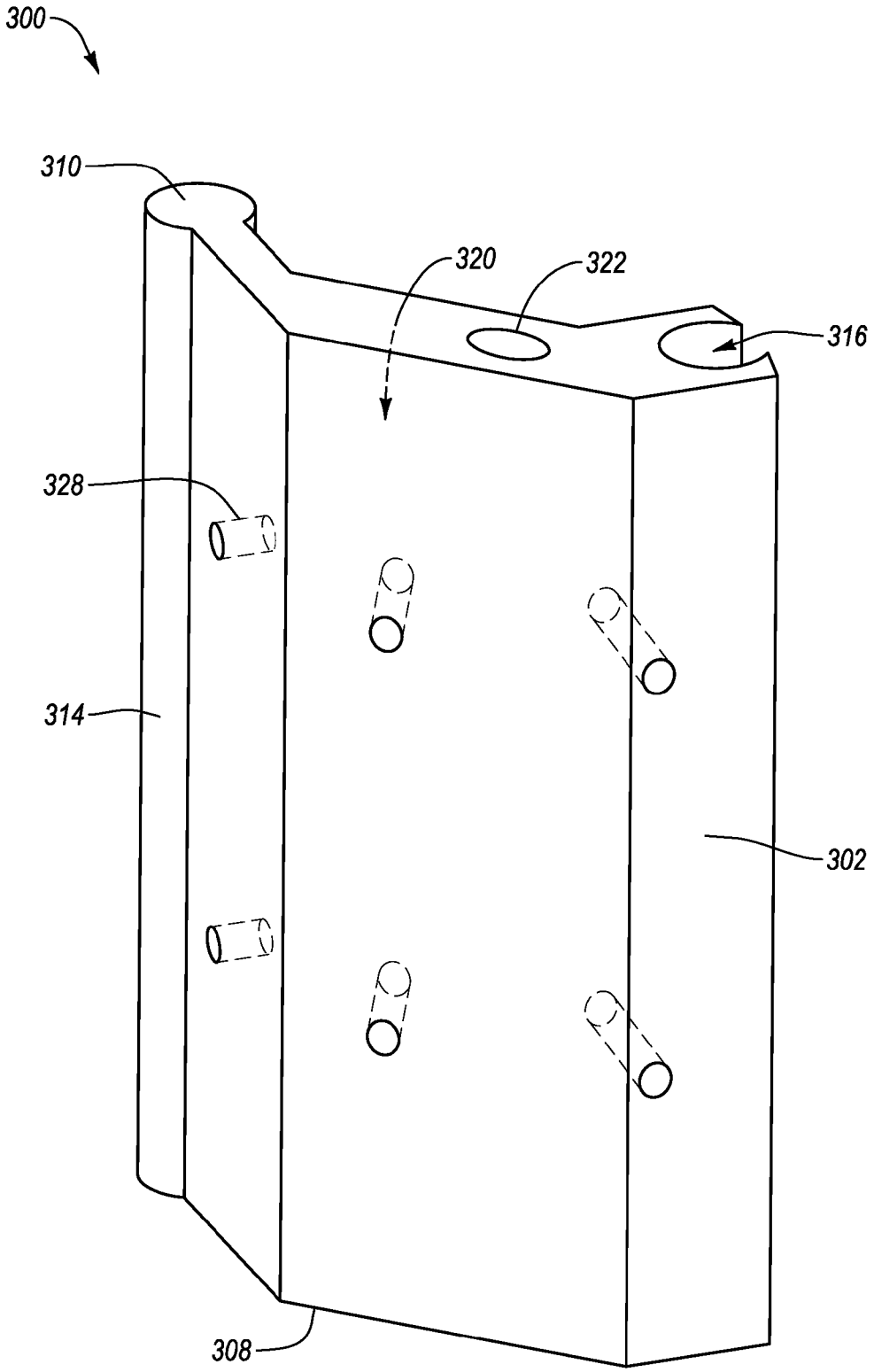
FIG. 9B illustrates a front view of an example embodiment of a corner barrier.

Just as there can be circumstances in which it is desirable that flood control wall 200 bend or curve, there can be other circumstances where it is desirable that flood control wall 200 have about a ninety degree corner to effectively control flood waters. In such circumstances a corner barrier 300 as shown in FIGS. 9A and 9B may be used with flood control barriers 100 to produce a ninety degree corner on flood control wall 200. In addition, other barriers can be designed to provide various degrees of corners or shapes. Thus, it will be appreciated that not all flood control barriers need have the same configuration, size, or shape, and different flood control barriers may, for example, provide straight, curved, angled, inclined, cornered, or other types of sections for a flood control wall.

A corner barrier 300 can include the same or similar characteristics, function, materials, etc. as described herein with respect to flood control barrier 100. Therefore, the above discussion regarding flood control barrier 100 is hereby incorporated with respect to the corner barrier 300.

One example embodiment of a corner barrier 300 is illustrated in FIGS. 9A and 9B. In the illustrated embodiment, corner barrier 300 can include a front wall 302, a back wall 304, a top portion 306, and a bottom portion 308 that form a substantially rigid body around a hollow portion 120. Corner barrier 300 can further can include a first end 310 with a connection member 314, and a second end 312 with a connection recess 316. Connection member 314 and connection recess 316 may be configured to correspond and interface with corresponding connection recesses 116 and connection members 114 on flood control barrier 100, such that the corner barrier 300 connects with the flood control barrier 100. In some cases, a corner barrier 300 may also connect to another corner barrier 300.

Corner barrier 300 can be configured to change the direction of a flood control wall by about ninety degrees, or in some other angle increment. In other words, flood control wall 200 connected to first end 310 of corner barrier 300 may be, for example, about ninety degrees offset from flood control wall 200 connected to second end 312 of corner barrier 300. In one example, as shown in FIGS. 9A and 9B, the ninety degree offset in corner barrier 300 is accomplished by a middle section that is offset forty-five degrees from side sections. In an alternative embodiment, the ninety degree corner may be rounded, or any other configuration can be used that can change the direction of the flood control wall 200 by ninety degrees or some other desired increment.

As illustrated in FIGS. 9A and 9B, the corner barrier 300 can include one or more fill ports 322 to fill hollow portion 320 with a pourable material, such as water. In addition, corner barrier 300 can include one or more drain ports 324 to drain the pourable material from corner barrier 300. Also shown in FIGS. 9A and 9B, corner barrier 300 can also include support rods 328 to increase the structural integrity of the corner barrier 300.

Figure 9C:
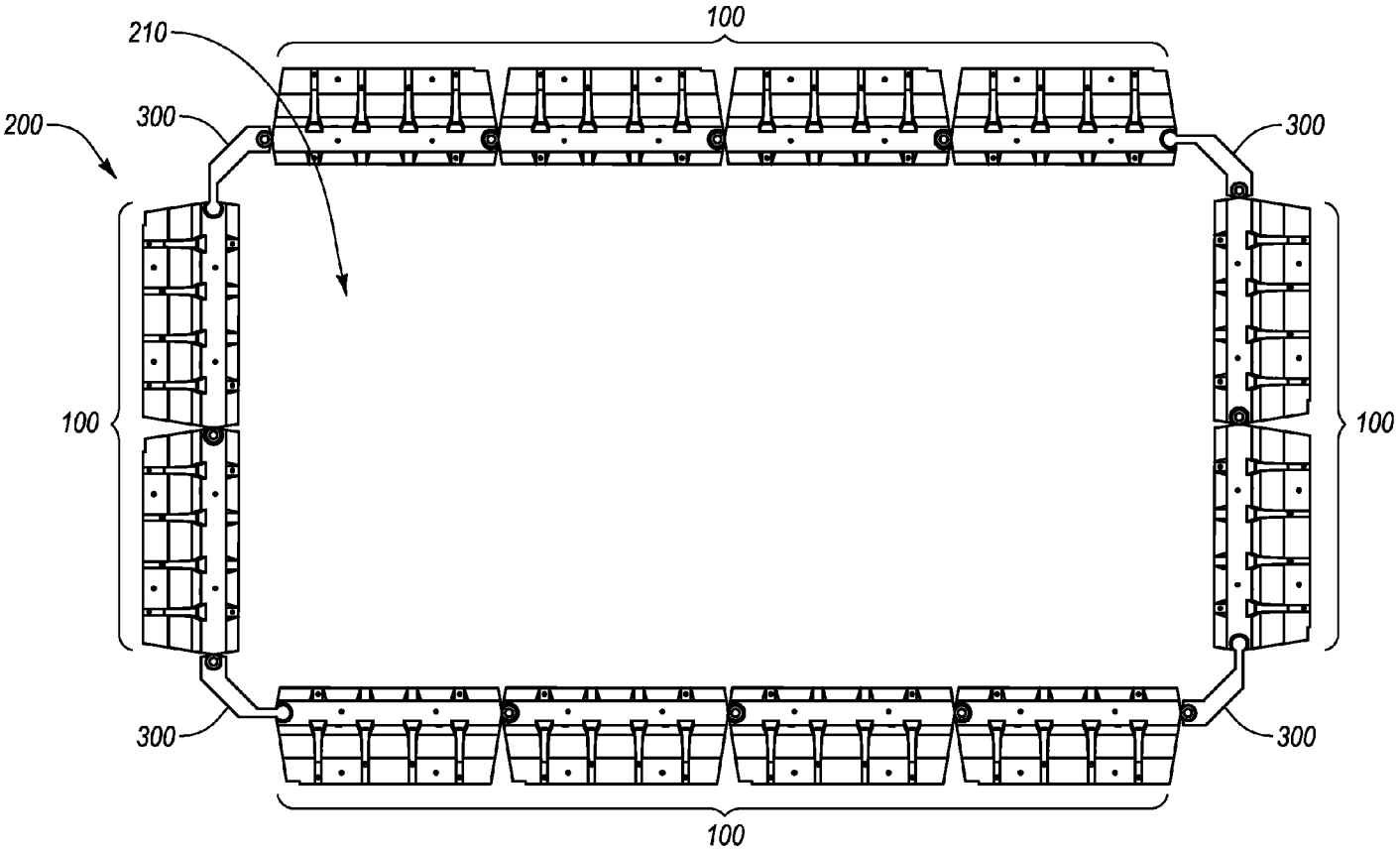
FIG. 9C illustrates the implementation of a corner barrier in a flood wall.

FIG. 9C illustrates one example embodiment of a flood control wall 200 in which corner barriers 300 are used. As illustrated, corner barriers 300 can be connected to a series of flood control barriers 100 to form a flood control wall 200. In the example embodiment shown in FIG. 9C, corner barriers 300 are used to effectively and efficiently surround a middle area 210. In one embodiment, middle area 210 may include a home or other property to be protected. In other embodiments, corner barriers 300 may be used to create various other embodiments of a flood control wall 200.

Figure 10A:
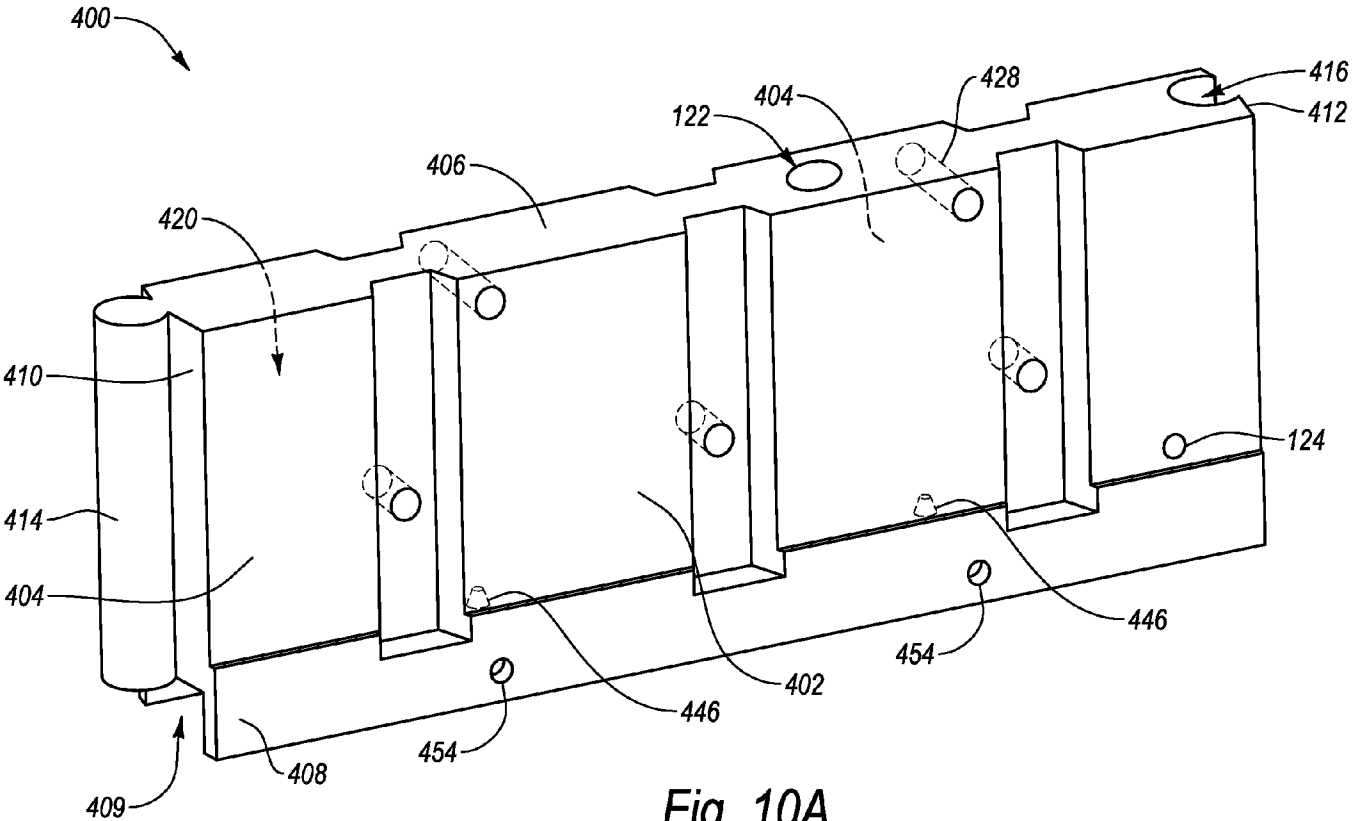
FIG. 10A illustrates a perspective view of an example embodiment of an extension barrier.

Just as terrain and flood conditions may require the use of a corner barrier 300, there can be circumstances in which it is necessary to add height to flood control barrier 100 or corner barrier 300. For example, the amount of water in combination with the terrain characteristics may present a situation in which the flood waters would otherwise spill over the flood control wall 200 unless height is added to flood control barriers 100 or corner barriers 300. In these situations, an extension barrier 400, an example of which is illustrated in FIG. 10A, can be used to add additional height to flood control barrier 100. As will be appreciated by one skilled in the art, extension barrier 400 is illustrated as a straight section to correspond to flood control barrier 100, but a similar extension can be produced to connect to corner barriers 300.

Extension barrier 400 can include the same or similar characteristics, function, materials, etc. as described with respect to flood control barrier 100 above. Therefore, the above discussion regarding flood control barrier 100 is hereby incorporated with respect to extension barrier 400.

In particular, extension member 400 includes a front wall 402, a back wall 404, a top portion 406, and a bottom portion 408 that forms a substantially rigid body around a hollow portion 420. Extension barrier 400 further can include a first end 410 with a connection member 414, and a second end 412 with a connection recess 412. Connection member 414 and connection recess 416 are configured to correspond and interface with adjacent connection recess 416 or connection member 414, respectively, on an adjacent extension member 400.

Moreover, and as illustrated in FIG. 10A, extension barrier 400 can include one or more fill ports 422 to fill hollow portion 420 with a pourable material, such as water. In addition, extension barrier 400 can include one or more drain ports 424 to drain the pourable material from extension barrier 300. Also shown in FIG. 10, extension barrier 400 can include support rods 428 to increase the structural integrity of the extension barrier 400.

In use, extension barrier 400 is configured to be connected to top portion 106 of flood control barrier 100 (FIG. 1) such that the overall height of flood control barrier 100 is increased. In order to securely attach extension barrier 400 to flood control barrier 100, extension barrier 400 includes, in this embodiment, an attachment recess 409 on bottom portion 408. In one example, attachment recess 409 is configured to correspond to the configuration, size, and/or shape of top portion 106 of flood control barrier 100 such that extension barrier 400 can securely rest upon flood control barrier 100.

In order to further secure extension barrier 400 to flood control barrier 100, bottom portion 408 may further include one or more indentations 446 that are positioned to align and interface with protrusions 144 located on top portion 106 of flood control barrier 100. In other example embodiments, bottom portion 408 can include additional indentations, protrusions, tolerances, and/or other geometry that assist in securing and stabilizing extension barrier 400 to flood control barrier 100.

In addition or alternative to indentations 446, extension barrier 400 can include lock ports 454. For example, and as illustrated in FIG. 10A, lock ports 454 can be ports positioned on or near bottom portion 408 of extension barrier 400. In one example embodiment, lock ports 454 may align with lifting pole ports 154 located in the flood control barrier 100. Therefore, once extension barrier 400 is placed on flood control barrier 100, a lock rod or pole may be inserted into one lock port 454, extended through lifting pole ports 145, and engage lock port 454 locked on the opposite side of extension barrier 400. In this way, extension barrier 454 can be securely attached to flood control barrier 100 resulting in a flood control barrier with a greater height.

Figure 10C:
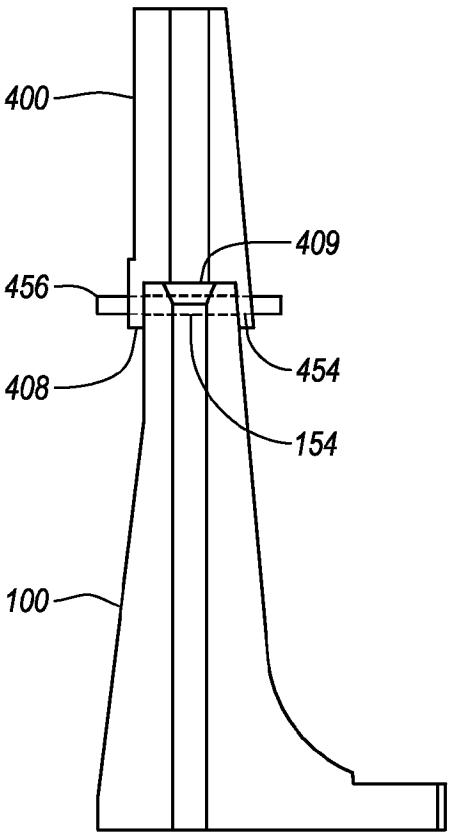
FIGS. 10B and 10C illustrate a front and side view of an example connection between of the extension barrier and the water management barrier.
Figure 10B:
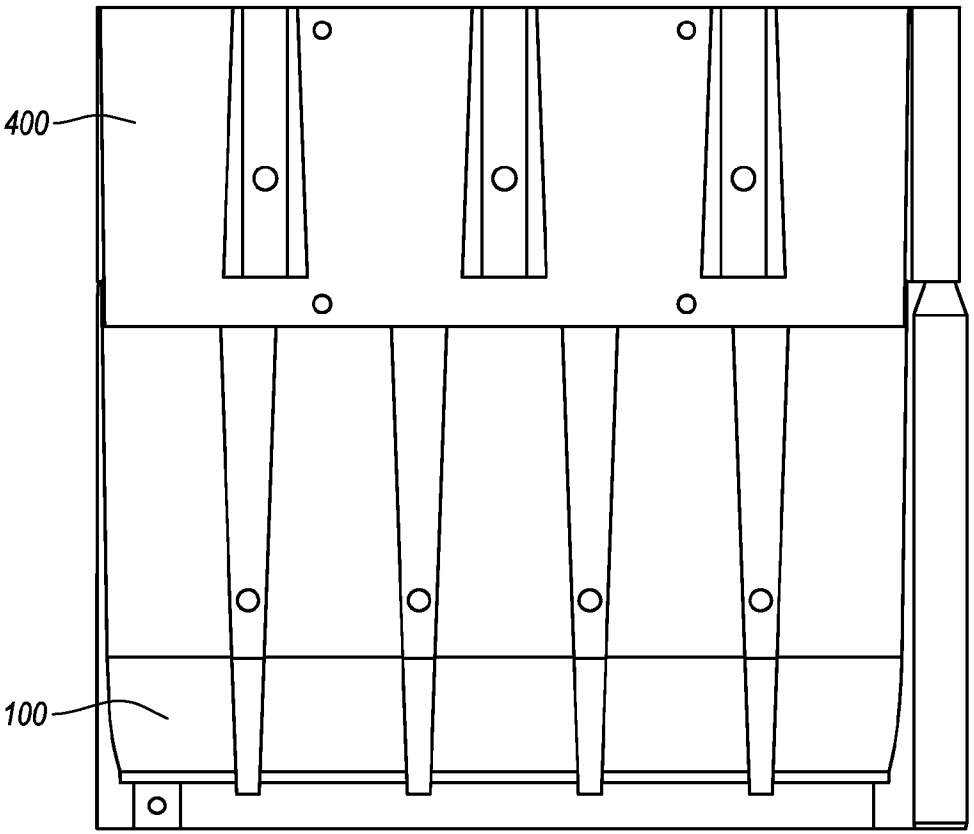

FIGS. 10B and 10C illustrate one example embodiment of flood control barrier 100 that is coupled to extension barrier 400. FIG. 10B illustrates a front view of one example embodiment. As can be seen, the illustrated embodiment includes an extension barrier 400 that may add a significant amount of height to the flood control barrier 100. In one example embodiment, extension barrier 400 can add about one foot to about three feet to the height of flood control barrier 100. In other embodiments, the height added can be larger or smaller depending on the overall configuration of flood control barrier 100 and extension barrier 400. For example, one example embodiment of an extension barrier 400 may add about two feet to the height of flood control barrier 100.

FIG. 10C illustrates an example side view of the extension member 400 attached to the flood control barrier 100. As can be seen, top portion 108 may be secured to extension member 400 by placing top portion 108 within attachment recess 409. Moreover, a lock rod 456 can be extended through one or more of lock ports 454 and lifting handle ports 154 such that extension barrier 400 is further secured to flood control barrier 100.

Figure 11:
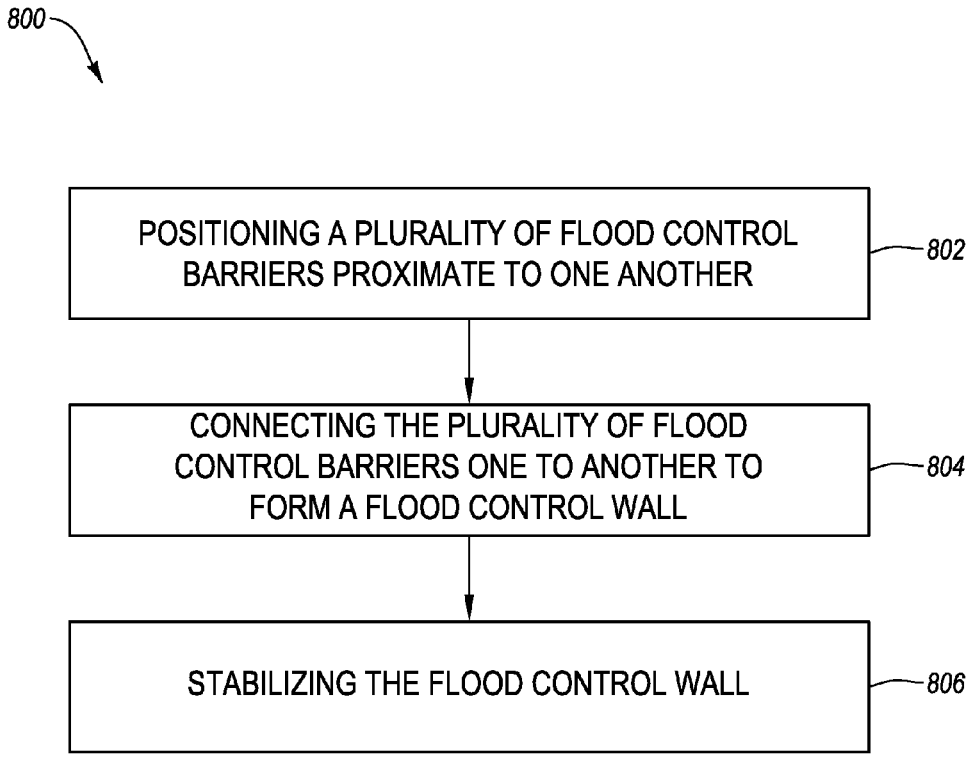
FIG. 11 illustrates an example method of assembling a flood wall.

The preceding text and corresponding figures provide a number of different components and modules that can be used to efficiently construct a flood control wall to control flood water. In addition to the foregoing, embodiments of the present invention can also be described in terms of one or more acts in a method for accomplishing a particular result. For example, FIG. 11 schematically illustrates a method of assembling a flood control wall. The acts of FIG. 11 are discussed more fully below with respect to the components of FIGS. 1 through 10C.

For example, FIG. 11 shows that a method 800 in accordance with an embodiment of the invention can comprise an act 802 of positioning a plurality of flood control barrier proximate to one another. Act 802 can involve positioning a plurality of flood control barriers proximate to an area that needs, or may need, protection from flood water, contaminants, or otherwise needs containment. For example, as shown in FIG. 9C, a plurality of flood control barriers 100 may be positioned next to one another.

Continuing, FIG. 11 shows that method 800 in accordance with an embodiment of the invention can further comprise an act 804 of connecting the plurality of flood control barriers one to another to from a flood control wall. Act 804 can involve coupling or connecting the flood control barriers by way of connection members and connections recesses located on the ends of the flood control barriers. For example, and as shown in FIGS. 7A through 8B, the plurality of flood control barriers 100 may be connected one with another by way of the connection member 114 in one flood control barrier 100 and the connection recess 116 in an adjacent flood control barrier 100 and/or corner barrier 300.

Additionally, FIG. 11 shows that in one example embodiment, method 800 can further comprise an act 804 of stabilizing the flood control wall. Act 806 can involve filling the flood control barrier with a pourable material such that additional weight is added to the flood control barriers. For example, and as explained with reference to FIGS. 1 and 2, the flood control barrier 100 can include a fill port 122 that can be used to allow the flood control barrier 100 to be filled with water, thus providing additional weight and stability to the flood control barrier 100.

In addition to the acts shown in FIG. 11, the method of constructing the flood control wall 300 can include various other acts. For example, in one embodiment of a method of constructing a flood control wall, a waterproof membrane 500 can be draped over at least a portion of flood control barrier 100. For example, waterproof membrane 500 can be draped over a portion of the front wall, over the top portion, down the back wall, over the foot member, and out over the land proximate to flood control barrier 100, although this particular configuration is merely exemplary. In one example embodiment, waterproof membrane 500 is a sheet of plastic or a sheet of other waterproof or water resistant material. The force of flood water 600 on waterproof membrane 500 can provide additional support to flood control barrier 100, as well as provide an additional measure to block water 600 from seeping underneath flood control barrier 100.

Figure 12:
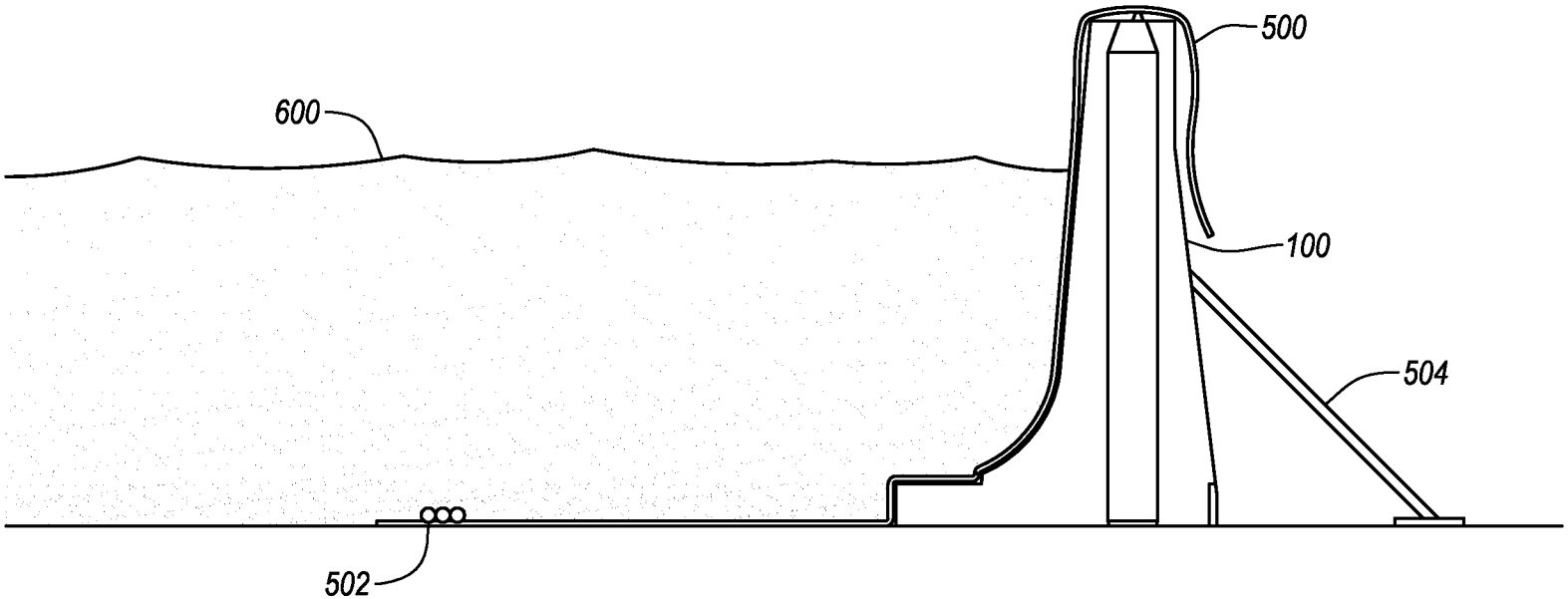
FIG. 12 illustrates additional devices that may be used in connection with the water management barriers.

When a waterproof membrane 500 is used in conjunction with the flood control barrier 100, it may be desirable in some cases to secure waterproof membrane 500 to a ground or other surface so that waterproof membrane 500 remains in place at least until the force of the water 600 is adequately upon the waterproof membrane 500. For example, in one embodiment, weights 502 may be placed on the edge of the waterproof membrane 500 as illustrated in FIG. 12. In one example embodiment, the weights 502 are lengths of chains that can provide the weight around the perimeter of the waterproof membrane 500. In other embodiments, other weight sources may be used. For instance, waterproof membrane 500 may have one or more holes therein and stakes, spikes, or other mechanisms may secure waterproof membrane 500 to the ground surface.

In addition to waterproof membrane 500, flood control barrier 100 can also be constructed with an additional support rod 504, as illustrated in FIG. 12. For example, in one embodiment, support rod 504 may be positioned be approximately near the top of flood control barrier 100. Support rod 504 may then be braced against the ground at approximately a forty-five degree angle such that flood control barrier 100 is further supported against the force from the water 600. Although not necessary, support rod 504 can be useful when flood control barrier 100 is in the path of a high current, which in turn can create large force upon flood control barrier 100. Of course, support rod 504 may have other configurations and can, for example, be connected to approximately a midpoint of flood control barrier 100, and angle towards the ground at more or less than a forty-five degree angle.

In still other embodiments, flood control barrier 100 may be supported in additional or alternative manners. For example, multiple support rods 504 may support a single flood control barrier 100. In other embodiments, an additional flood control barrier may be placed against the back-side of flood control barrier 100, and can be perpendicular to flood control barrier 100. Such an additional barrier can thus assist or replace support rod 504 in supporting flood control barrier, and can be particularly helpful in instances where the water being controlled or managed is exerting an intense pressure against a wall constructed of flood control barriers 100. Additionally, cables or chains can be weaved or passed through one or more of the ports in adjacent flood control barriers adding additional strength to the flood control wall 200. In one embodiment, an entire flood control wall 200 can be further connected together by weaving a cable through the ports of each flood control barrier 100 included in the flood control wall 200.

Referring now to FIGS. 13 through 18, a flood control barrier or water management barrier 700 will be described according to another embodiment. The water management barrier 700 may be similar in many respects to the flood control barrier 100 previously described above in relation to FIGS. 1 through 12. To the extent features or components of this configuration function in a manner similar to that as described above, such disclosure is hereby incorporated into the following additional configuration. Like structures and/or components are given like reference numerals.

Figure 13:
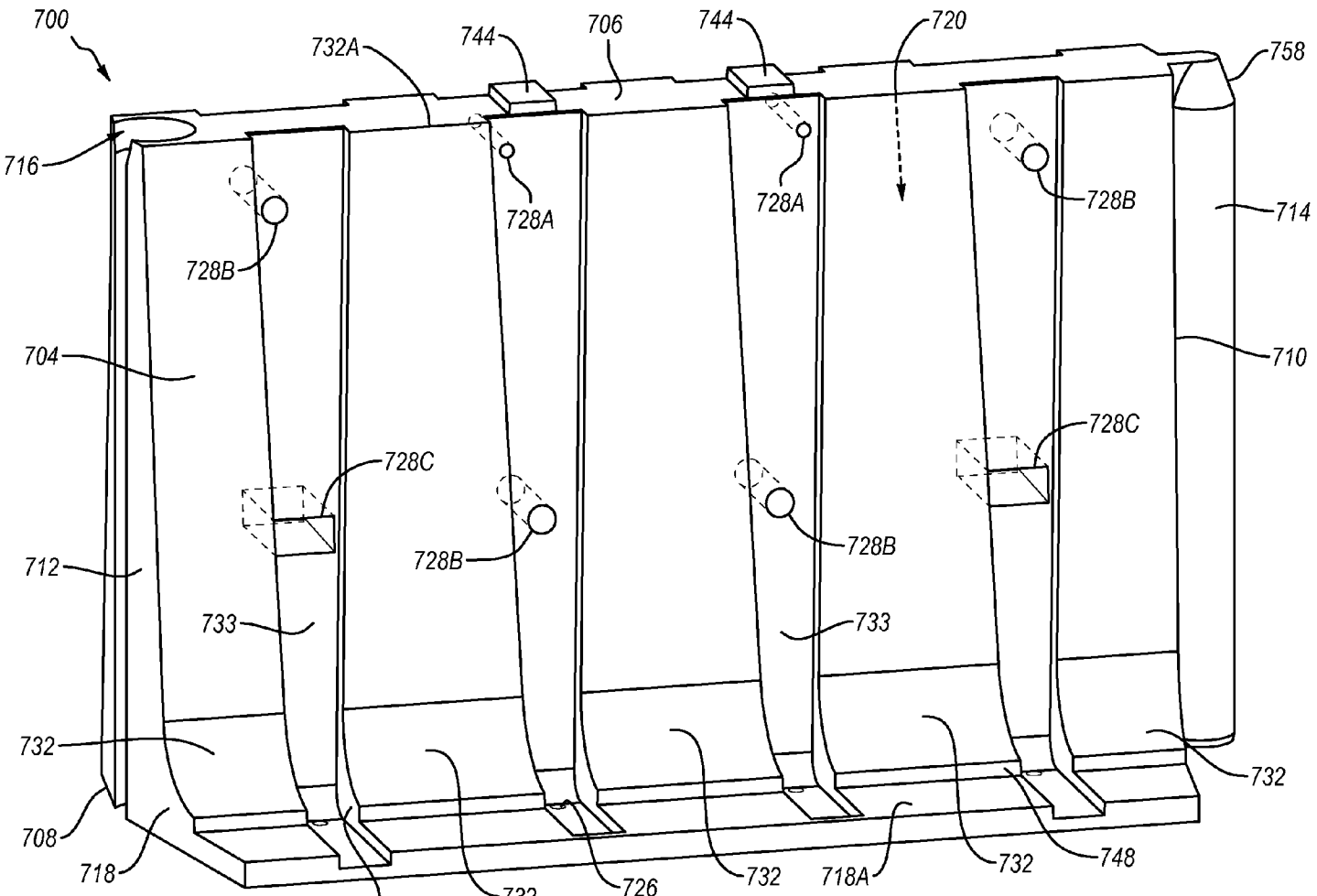
FIG. 13 illustrates a back-perspective view of a water management barrier according to another embodiment.

FIG. 13 is a back-perspective view of water management barrier 700. As shown, the water management barrier 700 may include a front wall 702 (shown in FIG. 14), a back wall 704 generally opposite the front wall 702, a top portion 706, and a bottom portion 708 generally opposite the top portion 706. The water management barrier 700 may further include a first end 710, extending between the top portion 706 and the bottom portion 708, and a second end 712 generally opposite the first end 710 also extending between the top portion 706 and the bottom portion 708. The front wall 702, the back wall 704, the top portion 706, and the bottom portion 708 may at least partially form a hollow body around a hollow portion 720.

In the illustrated embodiment, a connection member 714 may be formed or otherwise attached to the first end 710 and may be used to connect the first end 710 of the water management barrier 700 to the second end of another water management barrier. The connection member 714 may substantially extend between the top portion 706 and the bottom portion 708 of the water management barrier 700. In an embodiment, the connection member 714 may include a generally cylindrical body portion. The connection member 714 may also include a tapered end 758 at or near the top portion 706. The tapered end 758 may have a generally conical shape or any other shape that reduces the cross-sectional dimension of the connection member 714 near the top of the connection member 714 and/or the top portion 706. For example, the tapered end 758 may include an inner portion adjacent the first end 710 having a generally rectangular configuration so as to maximize the attachment surface area of the tapered end 758 of the connection member 714 to the first end 710. In addition, the tapered end 758 may include an outer portion having a semi-conical configuration to allow for a smoother initial interface with the connection recess 716 of an adjacently placed water management barrier 700, such that the connection member 714 does not have to be perfectly aligned with a connection recess to be connected together. A connection recess 716 may also be formed in or otherwise connected to the second end 712 of the water management barrier 700. The connection recesses 716 may facilitate another water management barrier being connected to the second end 712 of the water management barrier 700. While the connection member 714 is illustrated having a generally cylindrical body portion, in other embodiments, the connection member 714 may have a generally elliptical body portion, a generally rounded rectangular body portion, a generally conical body portion, or any other suitable body shape. For example, the connection member 714 may have a generally conical body portion having a base oriented at the bottom portion 708 of the water management barrier 700 that extends upward toward the top portion 706. In an embodiment, the diameter of the cone shape can decrease gradually as the cone extends toward the top portion 706. Such a configuration may allow a user to substantially tight seal between adjacent water management barriers 700. For example, a user may loosely insert the connection member 714 of one water management barrier 700 into the connection recess 716 of another water management barrier. The user may then orient each water management barrier relative to one another in any desired configuration. Once the user has the water management barriers 700 in the user's desired configuration, the user may force the connection member 714 further into the connection recess 716 such that the conical body portion of the connection member 714 is wedged or jammed within the connection recess 716 to form a sealed connection. In some embodiments, the sealed connection may be sufficiently tight to prevent flood water and/or other materials from passing between the barriers. In other embodiments, the sealed connection may significantly reduce seepage of flood water and/or other materials from between the barriers.

Also shown in FIG. 13, the water management barrier 700 may include a foot member 718 extending generally outwardly from the back wall 704. The water management barrier 700 may be constructed from any of the materials described above for the flood control barrier 100. Moreover, the water management barrier 700 may be connected to other water management barriers, extension barriers, and/or corner barriers to form a flood control wall similar to the embodiments shown and described in relation to FIGS. 7A through 12.

Considering the structure of the water management barrier 700 in more detail, and still referring to FIG. 13, the front wall 702, the back wall 704, the top portion 706, and the bottom portion 708 may form a hollow body that surrounds and/or substantially encloses the hollow portion 720. Similar to the hollow portion 120, the hollow portion 720 may be fillable with a pourable material such as water, foam, rocks, sand, beads, gel, combinations thereof, or the like. Filling the hollow portion 720 with the pourable material may provide rigidity, structural support, and/or insulation to the water management barrier 700. However, when a pourable material is placed within the hollow body, the hollow body may have a tendency to deform, swell, belly out, or increase in size or volume as a result of pressure exerted on the hollow body by the pourable material. In addition, as previously discussed, flood water, mud, and/or rocks may exert forces and/or pressures on the water management barrier 700 that tend to collapse the hollow body of the water management barrier 700 inward. For these reasons and others, the water management barrier 700 may include one or more features configured to help reinforce and/or stiffen the water management barrier 700.

Figure 14:
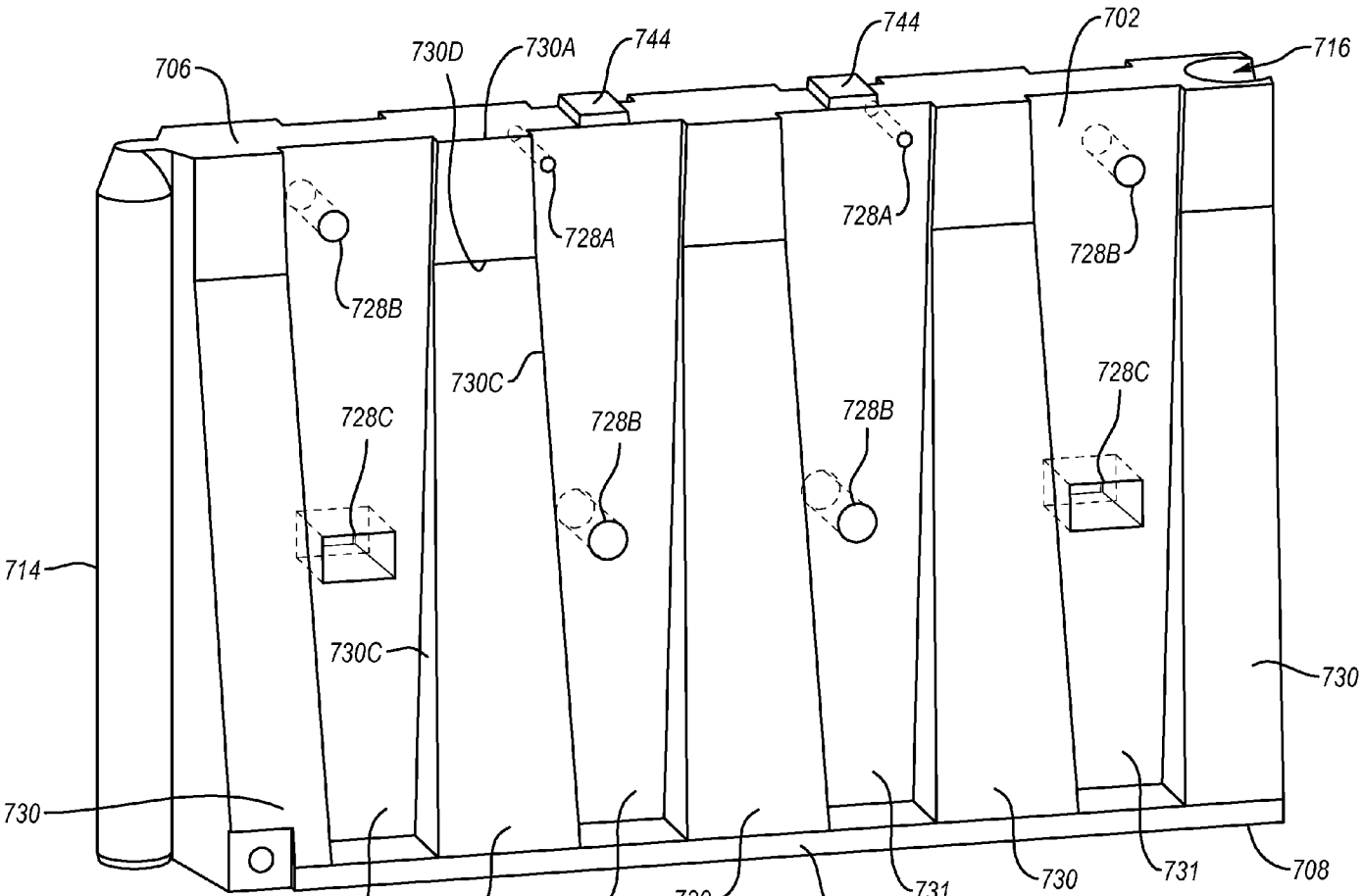
FIG. 14 illustrates a front-perspective view of the water management barrier shown in FIG. 13.

In one embodiment, as shown in FIG. 14, the front wall 702 of the water management barrier 700 may include a ribbed structure comprising raised portions 730 and intermediate channels 731 to help reinforce and/or stiffen the front wall 702. For example, the raised portions 730 and/or channels 731 may help the front wall 702 resist deformation due to one or more internal forces and/or pressure exerted on the front wall 702 from one or more pourable materials within the hollow portion 720. In other embodiments, the raised portions 730 and/or channels 731 may help the front wall 702 resist deformation due to one or more external forces and/or pressure exerted on the front wall 702 from equipment, water, rocks, or the like. As illustrated, the raised portions 730 may be spaced from each other and may substantially extend between the top portion 706 and the bottom portion 708. Each raised portion 730 may include opposing sidewalls 730C and a top surface extending between the opposing sidewalls 730C. In addition, the raised portions 730 may include a first end 730A at or near the top portion 706, and a second end 730B at or near the bottom portion 708. Each raised portion 730 may exhibit a width generally defined between the opposing side walls 730C of the raised portion 730. In the illustrated embodiment, the width of the second end 730B of the raised portion 730 may be greater than the width of the first end 730A such that each raised portion 730 exhibits a generally trapezoidal geometry. In addition, each raised portion 730 may exhibit a thickness generally defined between the top surface of the raised portion 730 and the channel 731. As also shown, the thickness of each raised portion 730 may vary. For example, the thickness of each raised portion 730 may be greater at the second end 730B than the first end 730A. More particularly, the thickness of one or more of the raised portions 730 may taper from the second end 730B toward an intermediate point 730D between the first end 730A and the second end 730B. From the intermediate point 730C to the first end 730A, the thickness of each raised portion 730 may be generally uniform. Thus, each raised portion 730 can exhibit a greater mass or size nearer the bottom portion 708 of the water management barrier 700 than the top portion 706.

Such a configuration may provide additional stiffness and/or reinforcement in the vicinity of the bottom portion 708 of the water management barrier 700 where pressure and/or forces from the pourable materials or other materials can be greater relative to the top portion 706.

Referring still to FIG. 14, the raised portions 730 may define channels substantially extending between the top portion 706 and the bottom portion 708. More particularly, the channels 731 may be defined between the sidewalls 730C of adjacent raised portions 730 and a bottom surface. As will be appreciated in view of the disclosure herein, the combination of raised portions 730 and the channels 731 may provide additional stiffness and/or reinforcement to the water management barrier 700 in part because the raised portions 730 and the channels 731, may act as a type of ribbed structure to support and/or stiffen the front wall 702, such that the front wall's 702 capacity to resist deformation when placed under external and/or internal pressure and/or forces is improved.

Like the raised portions 130, the geometric configuration of the raised portions 730 and/or the channels 731 may vary from one embodiment to the next. For example, one or more of the raised portions 730 may exhibit a thickness that is generally uniform. In other embodiments, the thickness and/or the width of the raised portions 730 may vary from one raised portion 730 to another. In yet other embodiments, one or more of the channels 731 and/or the raised portions 730 may exhibit a generally rectangular geometry, a generally curved geometry, a generally elliptical geometry, or the like. Moreover, while five raised portions 730 and four channels 731 are illustrated, in other embodiments the front wall 702 may include more or fewer raised portions 730 and/or the channels 731, respectively, depending on the configuration of the water management barrier 700. In some configurations, the raised portions 730 may be at least partially solid. In other embodiments, the raised portions 730 may be at least partially hollow. In some embodiments, the raised portions 730 and/or channels 731 may extend between the first end 710 and the second end 712. In yet other embodiments, the raised portions 730 and/or channels 731 may extend along only a portion of the front wall 702. For example, the raised portions 730 and/or the channels 731 may extend along the front wall 702 between the top portion 706 and an intermediate point between the top portion 706 and the bottom portion 708.

In an embodiment, the raised portions 730 and/or the channels 731 may be formed on the front wall. In other embodiments, the raised portions 730 and/or the channels 731 may be formed in the front wall. In yet other embodiments, the raised portions 730 and/or channels 731 may be attached to the front wall 702 by any suitable means such as adhesives, fasteners, welds, or the like.

Referring again to FIG. 13, the back wall 704 of the water management barrier 700 may also include raised portions 732 spaced from each other and channels 733 defined between the raised portions 732. In the illustrated embodiments, the raised portions 732 may exhibit a generally non-planar geometry with a first end 732A near the top portion 706 and a second end 732B near the bottom portion 708. The second end 732B may curve outwardly from the first end 732A. Like the raised portions 730, the raised portions 732 may exhibit a thickness and width greater nearer the second end 732B than the first end 732A. The channels 733 may substantially extend between the top portion 706 and a free end of the foot member 718 and may include a base surface. In the illustrated embodiment, the outer two channels 733 may be open ended or may include an opening at the free end of the foot member 718 and the inner two channels 733 (located between the outer channels 733) may be closed ended or may end at a substantially upright wall extending from the free end of the foot member 718. In other embodiments, any or all of the channels 733 may be open ended and/or closed ended at or near the free end of the foot member 718.

Similar to the raised portions 730 and the channels 731, the raised portions 732 and/or the channels 733 may provide additional reinforcement and/or stiffness to the water management barrier 700. For example, as flood waters, mud, rocks, debris flow, or the like build up against the back wall 704, extremely large forces and/or pressure may act normal to the back wall 704 of the water management barrier 700, such that the back wall 704 could tend to collapse into the hollow portion 720. The ribbed configuration of the raised portions 732 and the channels 733 may help stiffen and/or reinforce the back wall 704 against such collapse. Like raised portions 730 and the channels 731, the raised portions 732 and/or the channels 733 may vary from one embodiment to another. For example, the width, orientation, length, and/or height may vary from one embodiment of the water management barrier 700 to another, from one raised portion 732 and/or channel 733 to another, or within the same raised portion 732 and/or channel 733.

Figure 15:
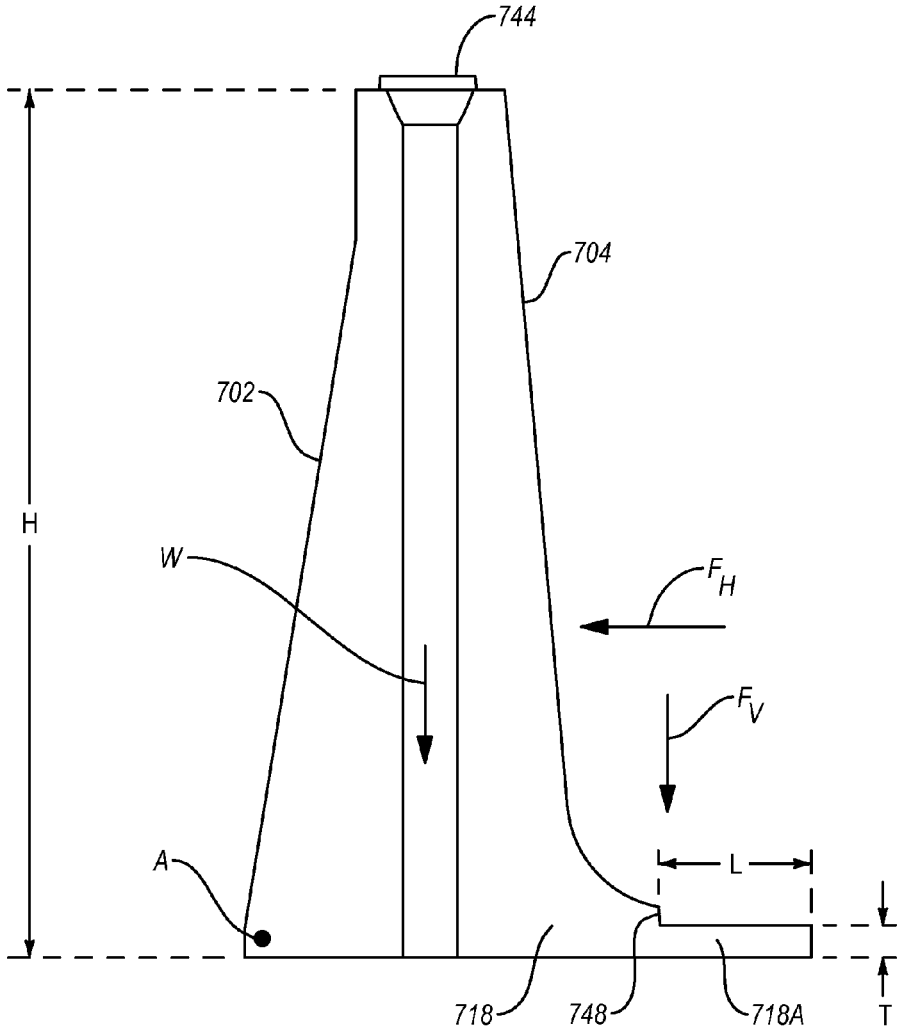
FIG. 15 illustrates a side view of the water management barrier shown in FIG. 13.

Another way in which the water management barrier 700 may be strengthened, stiffened, reinforced, and/or stabilized is through the foot member 718. As illustrated in FIGS. 13 and 15, the foot member 718 may extend outward from back wall 704. The foot member 718 may include the curved portions of the raised portions 730 and a toe-like portion 718*a* extending therefrom. The toe-like portion 718A of the foot member 718 may have an upper surface generally parallel to a bottom surface of the bottom portion 708 of the water management barrier 700.

In the illustrated embodiment, the toe-like portion 718A of the foot member 718 may exhibit a relatively low-profile. For example, the toe-like portion 718A may exhibit a thickness T generally defined between the upper surface and the bottom portion 708. In an embodiment, the thickness T of the toe-like portion 718A may be between about one-half inch and about six inches; between about one inch and about five inches; or between about one and a half inches and three inches. In other embodiments, the thickness T of the toe-like portion 718A of the foot member 718 may be larger or smaller. In other embodiments, the thickness T of the toe-like portion 718A may be about ten percent; about fifteen percent; about twenty percent; about twenty-five percent of the length L of the toe-like portion 718A. In yet other embodiments, the thickness T of the toe-like portion 718A may be between about five percent and about forty percent; between about ten percent and about thirty percent; or about fifteen percent and about twenty-five percent of the length L of the toe-like portion 718A. In other embodiments, the dimensional relationship between the thickness T and the length L of the toe-like portion 718A may be greater or less relative to one another.

Figure 18:
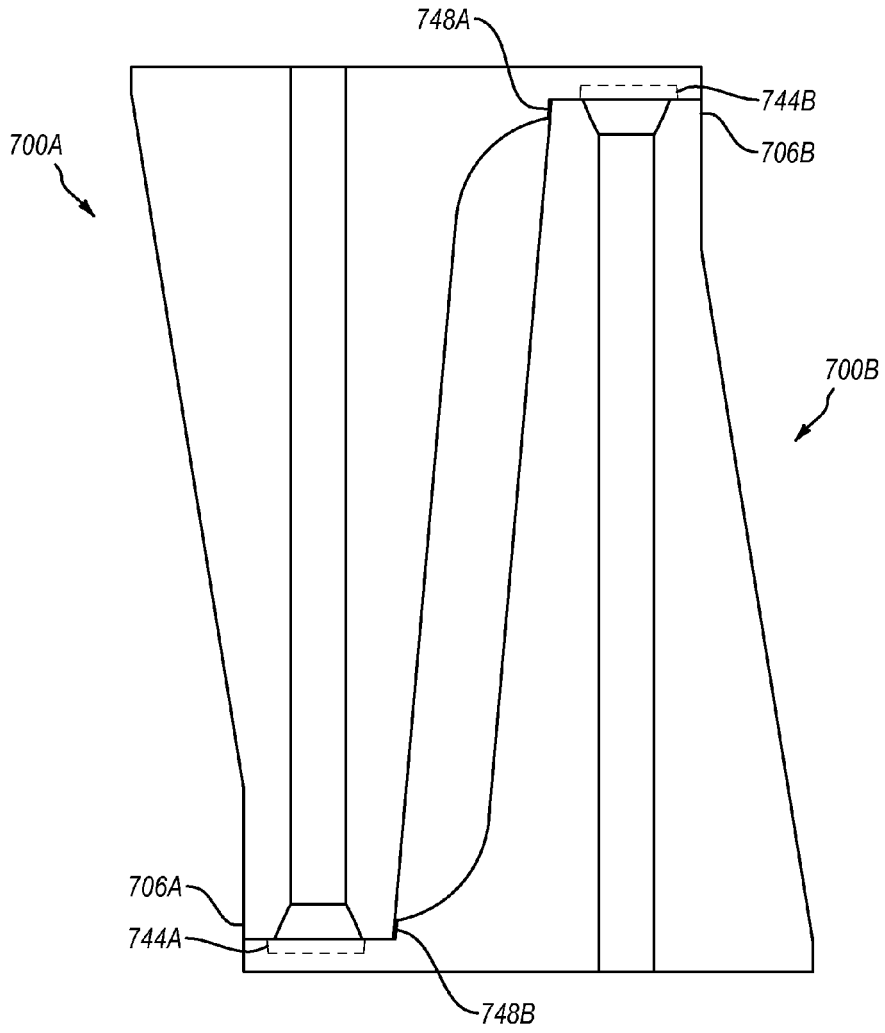
FIG. 18 illustrates a side view of two water management barriers in a storage configuration.

Such a low-profile configuration of the toe-like portion 718A may allow a waterproof membrane, draped over the foot member 718 and the land or support surface proximate to the water management barrier 700, to be less likely to tear when stepped upon or under the weight of flood water. In addition, the low-profile configuration of the toe-like portion 718A may help reduce the overall or stacked height of two or more water management barriers in a storage configuration. For example, as shown in FIG. 18, the overall height of the water management barriers 700*a*, 700*b* in a storage configuration similar to the storage configuration illustrated in FIG. 12 may be lessened due in part to the reduced thickness of the toe-like portions.

In an embodiment, the height H of the water management barrier 700 may be about forty-six and three quarter inches and the thickness of the toe-like portion 718A may be about one and three quarter inches. Such a configuration may allow about ninety-six water management barriers 700, in the storage configuration, to be shipped on a standard flatbed trailer. Thus, the water management barriers 700 may be less expensive to ship and more available to a user. Of course, in other embodiments, the size and/or relationship between the height H of the water management barriers 700 and the thickness T of the toe-like portion 718A of the foot member 718 may be greater or less.

Referring now to FIGS. 13 and 15, in addition to the low-profile thickness of the toe-like portion 718A, the toe-like portion 718A may also be generally elongated to help stabilize and/or strengthen the water management barrier 700. For instance, when the water management barrier 700 is in use, water, mud, or the like can exert pressure forces that act normal to a submerged surface of the back wall 704 of the water management barrier 700. Such external forces can tend to push back and/or tip over the water management barrier 700. However, water or mud may also exert downward acting pressure forces generally normal to the foot member 718 of the water management barrier 700 that can help pin the water management barrier 700 against the ground or other support surface to help prevent the water management barrier 700 from being displaced or pushed back by the water or mud. In addition, the downward acting pressure forces from the water or mud may help prevent the water management barrier 700 from overturning or tipping over.

For example, FIG. 15 shows a free-body diagram with representative weight forces, and pressure forces that may act horizontally and vertically on the water management barrier 700. In the illustrated embodiment, forces are shown located at the centroid of the water management barrier 700 and running through the centroid of water over the toe-like portion 718A and at the location wherein the horizontal hydrostatic force could be located. As shown, water may exert a force $F_H$ that acts horizontally on the back wall 704 of the water management barrier 700 to produce an overturning moment in a positive direction about point A. The water may also exert a force $F_v$ that acts vertically on the toe-like portion 718A to produce a resisting overturning moment in a negative direction about point A. In addition, the weight of the water management barrier 700, including the pourable material within the hollow portion 720 (shown in FIG. 13) of the water management barrier 700, may exert a weight force W that acts vertically to produce another resisting overturning moment in the negative direction about point A. Because the resisting overturning moments are opposite the overturning moment, the resisting overturning moments may help minimize and/or negate the effect of the overturning moment. For example, in some embodiments, the water management barrier 700 may be configured such that the resisting overturning moments are greater than the overturning moment to prevent the water management barrier 700 from overturning. In other embodiments, the water management barrier 700 may be configured such that the resisting overturning moments along with other reinforcing features, such as, for example, a liner or straps, may help prevent the water management barrier 700 from overturning. Thus, the water management barrier 700 may include various features configured to help prevent the water management barrier 700 from overturning and/or being displaced.

By increasing the length of the foot member 718 and/or the toe-like portion 718A, the centroid of water or mud over the foot member 718 is at a greater distance from point A thereby producing a greater resisting overturning moment. Moreover, the dimensional relationship between the back wall 704 and the foot member 718 may influence the magnitude of the resisting overturning moments relative to the overturning moment or the capability of the water management barrier 700 to resist overturning. In an embodiment, the height H of the water management barrier 700 may be generally defined between the top portion 706 and the bottom portion 708. For example, the eight H of the water management barrier may be between about twenty inches and about eighty inches; between about thirty inches and about sixty inches; or between about forty inches and about fifty inches. In an embodiment, the toe-like portion 718A of the foot member 718 may exhibit a length L generally defined between a free end of the toe-like portion 718A and a storage lip 748 or the curved portion of the foot member 718. For example, the length L of the toe-like portion 718A may be between about three inches and about forty inches; between about five inches and about twenty inches; or between about eight inches and about twelve inches. In other embodiments, length L of the toe-like portion 718A of the foot member 718 may be larger or smaller. In yet other embodiments, the length L of the toe-like portion 718A may be between about five percent and one-hundred and five percent; about ten percent and one-hundred percent; about twelve percent and thirty-five percent; about twenty percent and fifty percent; or about twenty-five percent and forty percent the height H of the water management barrier 700. In other embodiments the length of the toe-like portion 718A and the height H of the water management barrier 700 may be larger or smaller relative to each other.

Figure 17:
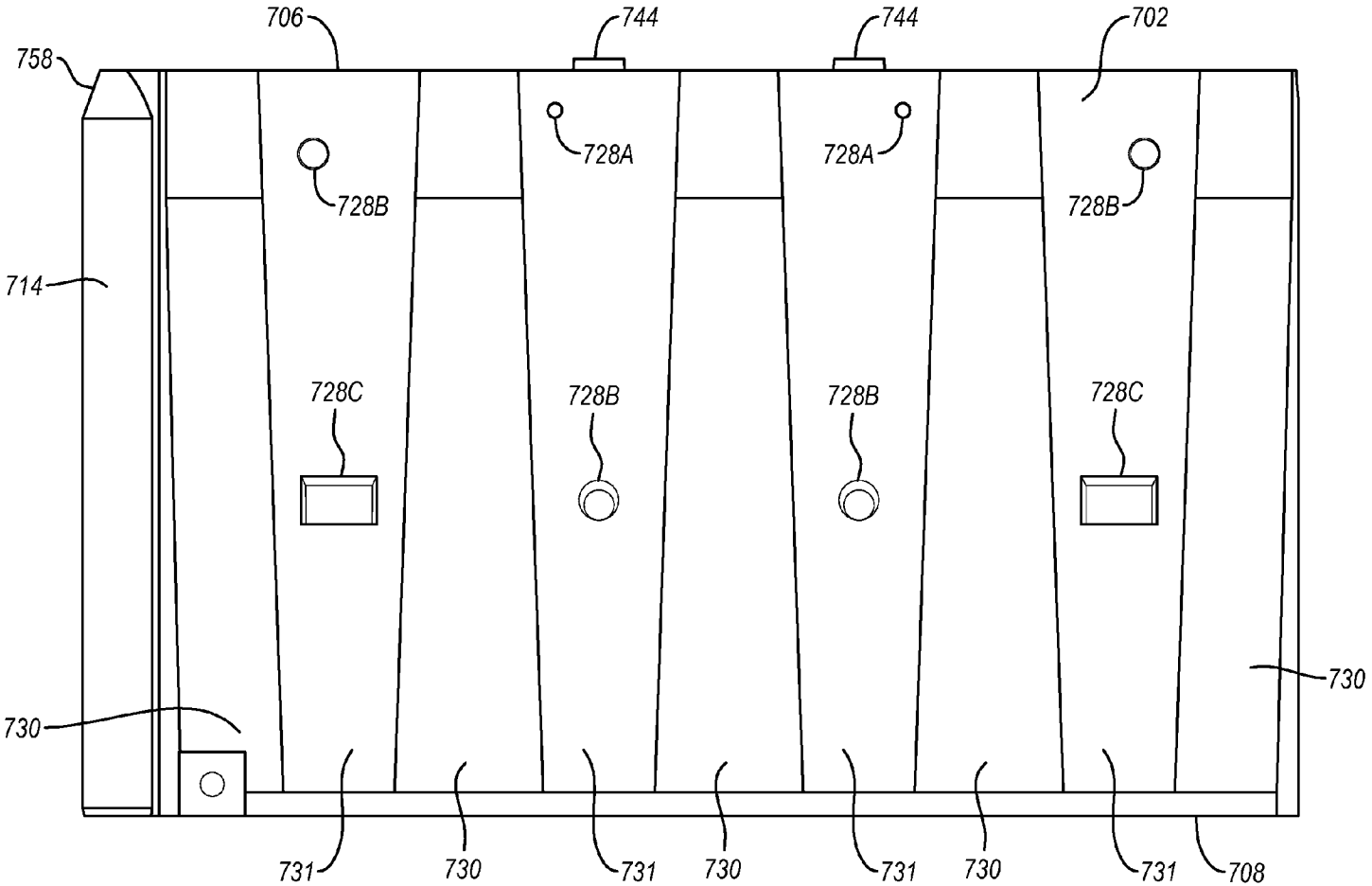
FIG. 17 illustrates another side view of the water management barrier shown in FIG. 13.

Another way in which the water management barrier 700 can be strengthened, reinforced, and/or stiffened is through the use of support rods or reinforcement tubes 728A, 728B, 728C. Referring now to FIG. 17, eight support rods 728A, 728B, 728C may be positioned between the front wall 702 and the back wall 704. More specifically, the support rods 728A, 728B, 728C may extend from the front wall 702, through the hollow portion 720, to the back wall 704. The support rods 728A may be positioned near the top portion 706 within the channels 731, 733. Two upper support rods 728B may be positioned below the support rods 728A and in different channels 731, 733 and two lower support rods 728B may be positioned in the same channels 731, 733 as the support rods 728A and near a mid-point between the top portion 706 and the bottom portion 708. The support rods 728C may be positioned in same channels 731, 733 as the upper support rods 728B and may be generally between and in line with the lower support rods 728B. As shown, the support rods 728A, 728B, 728C may have varying sizes and shapes. For example, the support rods 728A may have a generally cylindrical or elliptical cross-sectional shape. The support rods 728B may have a generally cylindrical or elliptical cross-sectional shape and may have a cross-sectional dimension greater than the support rods 728A. Further, the support rods 728C may have a generally rectangular cross-sectional shape and may exhibit a cross-sectional dimension greater than the support rods 728B.

Such support rods 728A, 728B, 728C may provide reinforcement and/or stiffness to the hollow body 720 of the water management barrier 700. For example, flood water and/or mud may exert pressure or external forces normal to the back wall 704, which would tend to cause the back wall 704 to collapse inward and towards the front wall 702. In addition, pourable materials with the hollow body 720 may exert pressure and/or internal forces normal to the back wall 704 and front wall 702 in an outward direction, which would tend to cause the front wall 702 and the back wall 704 to swell, bulge outward, or belly out. The support rods 728A, 728B, 728C can help resist such pressure and/or forces placed on the water management barrier 700 by reinforcing the front wall 702 and/or the back wall 704.

Optionally, the support rods 728A, 728B, 728C may perform additional functions and/or provide additional features to the water management barrier 700. For example, similar to the lifting pole ports 154, the support rods 728A may further comprise lifting pole ports through which lifting poles can be inserted. The support rods 728B may further comprise strap ports through which one or more straps can be inserted such that the water management barrier 700 may be secured to one or more other water management barriers or a trailer or other device. For example, one or more nylon straps made be inserted through the strap ports to restrain adjacent water management barriers 700. Furthermore, similar to the integral handles 152, the support rods 728C may further comprise handles so as to provide easily accessible grips. Due to the size and shape of the support rods 728C, the support rods 728C may further function as strap ports similar to the support rods 728B.

The configuration of the support rods 728A, 728B, 728C can vary from one embodiment to the next. For example, in some embodiments, the support rods 728A, 728B, 728C may comprise hollow tubes, solid tubes, or a combination of both. In other embodiments, the shape, position, and/or dimensions of the support rods 728A, 728B, 728C may vary. For example, the cross-sectional dimension of one or more of the support rods 728A, 728B, 728C may be about one inch to about two inches. In other embodiments, the cross-sectional dimensions of one or more of the support rods 728A, 728B, 728C may be larger or smaller depending on the desired configuration of the water management barrier 700. In addition, as illustrated in FIG. 17, the support rods 728A, 728B, 728C may have various cross-sectional shapes. In other embodiments, one or more of the support rods 728A, 728B, 728C may have a generally square, generally elliptical, generally triangular, or any other suitable cross-sectional shapes. Moreover, while the support rods 728A, 728B, 728C are shown as being generally elongated, this is not necessarily the case as the dimensions of the support rods 728A, 728B, 728C may vary. Further, in other embodiments, one or more of the support rods 728A, 728B, 728C may not be configured to provide reinforcement or support to the water management barrier 700, but rather may be configured as a strap port, a lifting pole port, and/or a handle only.

Figure 16:
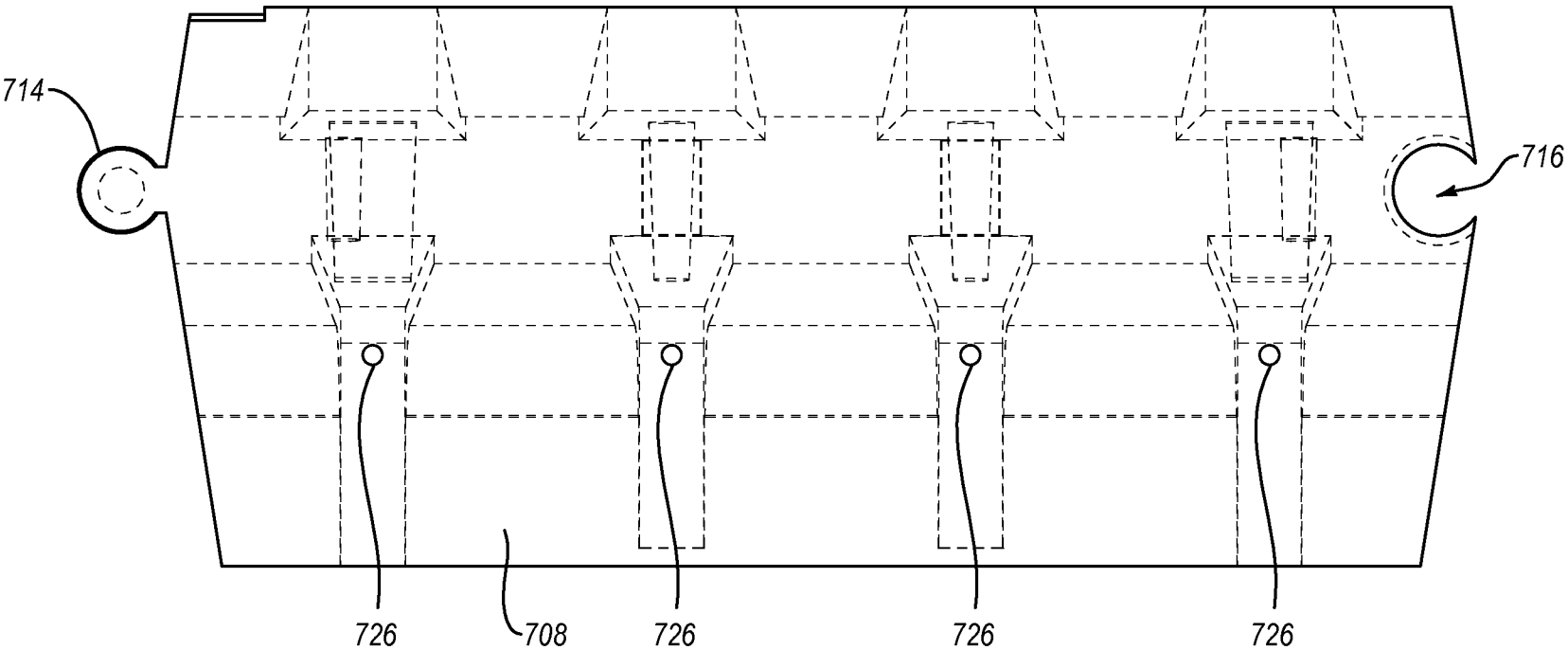
FIG. 16 illustrates a bottom view of the water management barrier shown in FIG. 13.

The water management barrier 700 may also be reinforced, stiffened, or straightened through the use of stake ports 726. As illustrated in FIGS. 13 and 16, stake ports 726 may be positioned in the channels 733 and between the curved portion of the foot member 718. Similar to the stake ports 126, the stake ports 726 can generally be configured to provide a port that extends between the foot member 718, through the hollow portion 720, to the bottom portion 708, so as to permit a stake, post, rod, spike, or other similar device, to be inserted through the stake port 726 and extend into the ground or other surface there below. In addition to providing a port, the stake ports 726 may provide reinforcement and/or stiffness to the water management barrier 700. For example, flood water and/or mud may exert pressure or forces normal to the foot member 718, which would tend to cause the foot member 718 to collapse inward towards the bottom portion 708 of the water management barrier 700. Moreover, pourable materials within the hollow body 720 may exert pressure or forces normal to the foot member 718 in an outward direction, which would tend to cause the foot member to bulge outward or belly out. In a manner similar to the support rods 728A, 728B, 728C, the stake ports 726 can help resist such pressure and/or forces placed on the foot member 718 of the water management barrier 700.

Similar to the stake ports 126, the number of stake ports 726 included within the water management barrier 700 may vary. In one example, as illustrated in FIG. 16, the water management barrier 700 may include four stake ports 726. In other embodiments, more or fewer stake ports 726 may be included within the water management barrier 700, and the number of stake ports 726 may vary depending on the overall size and/or configuration of the water management barrier 700. Moreover, the position of the stake ports 726 on the water management barrier 700 may vary depending on the size, shape, or other configuration of the water management barrier 700. For example, one or more of the stake ports 726 may be formed in the raised portions 732 on the curved portion of the foot member 718, closer to the toe-like portion 718A of the foot member 718, or higher on the back wall 704 within the channels 733.

Similar to the flood control barrier 100, the water management barrier 700 may include geometric features that provide for easier stacking and/or storage of multiple water management barriers 700 when not in use. For example, as illustrated in FIG. 13, the water management barrier 700 may include generally rectangular protrusions 744 that project from the top portion 706. The protrusions 744 may be configured to generally correspond to the portions of the channels 733 formed on the toe-like portion 718A of the foot member 718. For example, in one embodiment, the protrusions 744 may be configured to generally correspond to protrusion receptacles at least partially formed or defined by the inner two channels 733 and the upright wall extending from the free end of the toe-like portion 718A of the foot member 718. In other embodiments, the protrusions 744 may be configured to generally correspond to protrusion receptacles at least partially formed or defined in any or all of the channels 733, the foot member 718, and/or the raised portions 722. In other embodiments, the protrusion receptacles may be indentations. In yet other embodiments, the protrusions 744 may exhibit a generally trapezoidal geometric configuration, an elliptical geometric configuration, or any other suitable geometric configuration. In one embodiment, the generally larger and rectangular configuration of the protrusions 744 may help the protrusions 744 to be more easily locked in or positioned within the channels 733. For example, as the water management barrier 700 is filled with the pourable material and then emptied, the channels 733 and/or foot member 718 may become and/or remain slightly deformed or swollen due to the pressures of the pourable materials. In the event the channels 733 and/or foot member 718 become slightly deformed or swollen, the protrusions 744 and/or protrusion receptacles may allow greater tolerances between the two such that the protrusions 744 may still be positioned, locked, and/or wedged within the protrusion receptacles of the channels 733. Of course, the size, configuration, and/or position of the protrusions 744 may vary from one embodiment to the next. For example, while two protrusions 744 are shown, in other embodiments, the water management barrier 700 may include one, three, four, or any other suitable number of protrusions 744. In other embodiments, one or more of the protrusions 744 may include a female slot, groove, and/or aperture configured to correspond to and receive a male component of one or more of the protrusion receptacles or channels 733 to help secure the water management barrier 700 in the storage configuration.

In more detail, and as shown in FIG. 18, protrusions 744A of a first water management barrier 700A may be configured to lock or fit within the channels of a second water management barrier 700B. Furthermore, protrusions 744B of the second water management barrier 700B may be configured to fit with the channels of the first water management barrier 700B. Thus, the first water management barrier 700A may be stacked in a compact storage configuration next to the second water management barrier 700B, as illustrated in FIG. 18. Moreover, the protrusions 744 and the channels 733 (see FIG. 13) may allow the stacked water management barriers 700A, 700B to be stable while in a stacked configuration. In one embodiment, the generally rectangular configuration of the protrusions 744 may also help the protrusions 744 to be locked in or positioned within the channels 733. For example, as the water management barrier 700 is filled with the pourable material, the channels 733 may have a tendency to become slightly deformed or swollen. In the event the channels 733 become slightly deformed or swollen, the generally rectangular protrusions 744 may still possess the capability to be positioned, locked, and/or wedged in the channels 733 due to the larger size of the channels 733 and the protrusions 744.

The protrusions 744 may also help prevent a waterproof membrane draped over the top portion 706 of the water management barrier 700 from ripping or tearing. For example, although not necessary, a waterproof membrane can be draped over a portion of the front wall, over the top portion, down the backwall, over the foot member, and out over the land or other support surface proximate to the water management barrier 700 as shown and described in relation to FIG. 12. The generally rectangular configuration of the protrusions 744 may help minimize any pressure points and/or distribute the weight of the waterproof membrane over a greater area such that the waterproof membrane is less likely to tear and/or rip when draped over the protrusions 744.

In addition to the protrusions 744, the water management barrier 700 can optionally include a storage lip 748, as illustrated in FIG. 13. The storage lip 748 may be configured such that the top portion 706 of another water management barrier 700 cooperates with the storage lip 748 for secure and compact storage. For example, as illustrated in FIG. 18, the first water management barrier 700A includes a storage lip 748A. The top portion 706B of the second water management barrier 700B may interact with the storage lip 748A such that the first water management barrier 700A and the second water management barrier 700B are in a more stable and compact storage configuration. Similarly, top portion 706A of the first water management barrier 700A interacts with the storage lip 748B on the second water management barrier 700B.

Figure 19:
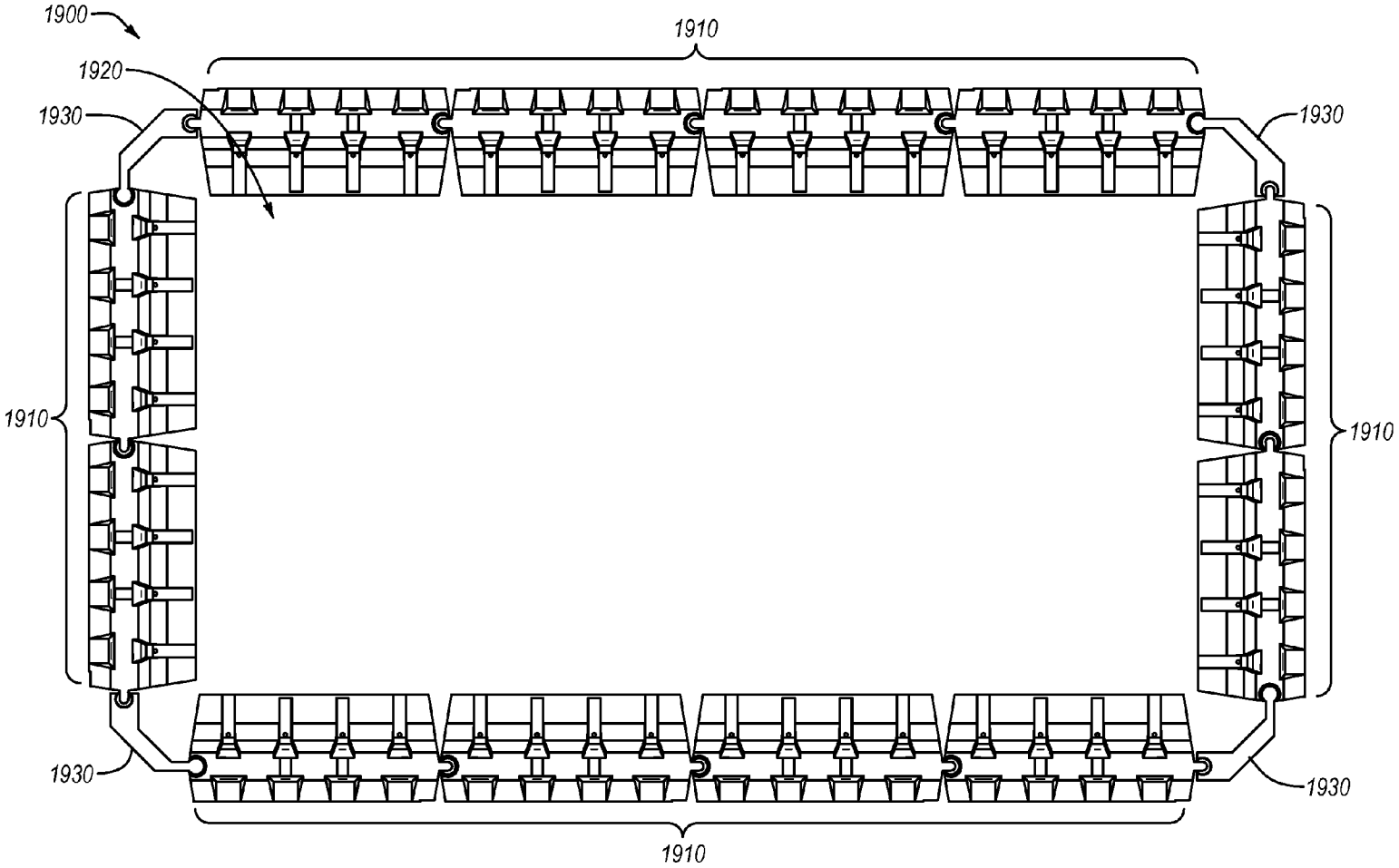
FIG. 19 illustrates a water management wall in which corner barriers are used according to another embodiment.

FIG. 19 illustrates another embodiment of a water management wall 1900 in which corner barriers are used. As illustrated, corner barriers 1930 may be connected to a series of water management barriers 1910 to form a water management wall 1900. Corner barriers 1930 may be similar to corner barriers 300. Moreover, water management barriers 1910 may be similar to any water management barrier (i.e., water management barrier 700) and/or flood control barrier disclosed herein. The corner barriers 1930 and the water management barriers 1910 may be used to form a generally rectangular containment area 1920. In other embodiments, the corner barriers 1930 and water management barriers 1910 may be used to form a generally square containment area, a generally trapezoidal containment area, a generally triangular containment area, a generally L-shaped containment area, or any other suitable shape of containment area.

In the illustrated embodiment, the back wall and foot member of each water management barrier 1910 are oriented toward the containment area 1920 such that the water management wall 1900 may be configured to help limit and/or prevent the escape of materials and/or fluids from the containment area 1920. In some embodiments, a liner (i.e., woven liner) or membrane may be used in conjunction with the water management wall 1900 to function as a containment liner. For example, a membrane similar to waterproof membrane 500 may be draped over the water management wall 1900 such that the membrane substantially lines the entirety of the containment area 1920. In other embodiments, the liner or membrane may be omitted.

In an embodiment, the containment area 1920 may be configured to store or retain liquids, water, chemicals, soil, contaminated materials, stockpiles and/or the like. In other embodiments, the containment area 1920 may include one or more storage tanks, pipelines, pressure vessels, well heads, frac tanks, and/or the like. For example, in the event of a tank leak, the water management wall 1900 may help contain the contents of the tank within the containment area 1920. Accordingly, the water management wall 1900 may help prevent and/or limit the tank contents from escaping into the environment. In other embodiments, the water management wall 1900 can enable controlled recovery, remediation, and/or disposal of the spill. In other embodiments, if a tank within the containment area 1920 requires maintenance and/or repair, one or more of the water management barriers 1910 and/or corner barriers 1930 may be conveniently removed from the water management wall 1900. Such a configuration may allow for ingress and/or egress of equipment and/or personnel to and from the containment area 1920 for repair and/or maintenance purposes. After the tank is repaired and/or maintained, the water management barriers 1910 and/or corner barriers 1930 may be conveniently reconnected to reconstruct the water management wall 1900 around the containment area 1920.

The invention is susceptible to various modifications and alternative means. Specific examples have been shown by way of example in the drawings and are described in detail herein. It should be understood, however, that the invention is not to be limited to the particular devices or methods disclosed. To the contrary, the invention is to cover all modifications, equivalents, and alternatives falling within the spirit and scope of the claims.

The invention claimed is:

1. A water management barrier comprising:

a hollow body at least partially defined by a front wall, a back wall, a top portion extending between said front wall and said back wall, a bottom portion generally opposite said top portion, a first end extending between said top portion and said bottom portion, and a second end extending between said top portion and said bottom portion; said hollow body exhibiting a height generally defined between said top portion and said bottom portion, wherein said hollow body is configured to receive one or more materials to at least partially fill said hollow body, and wherein said back wall includes a plurality of raised portions spaced from each other and extending substantially between said top portion and said bottom portion, said raised portions at least partially defining a plurality of channels extending substantially between said top portion and said bottom portion, wherein said raised portions and/or said channels are configured to help said front wall resist deformation due to internal forces and/or external forces being exerted on said front wall;

an elongated connection member connected to said first end and generally extending between said top portion and said bottom portion;

a connection recess formed in said second end, said connection recess being sized and configured to generally correspond to at least a portion of said connection member; and an elongated foot member attached to said bottom portion.

2. The barrier of claim 1, wherein one or more of said raised portions exhibit a thickness defined between a top surface thereof and a bottom surface of one or more of said channels, and wherein said thickness varies between said bottom portion of said hollow body and said top portion.

3. The barrier of claim 1, wherein said thickness is greater near said bottom portion of said hollow body than near said top portion.

4. The barrier of claim 1, wherein one or more of said raised portions exhibit a trapezoidal geometric shape.

5. The barrier of claim 1, wherein said raised portions and/or said channels are configured to help said front wall resist deformation between said top portion and said bottom portion due to one or more internal forces being exerted on said front wall.

6. The barrier of claim 1, wherein said foot member extends from said back wall and includes a curved portion and a toe portion extending from said curved portion, said toe portion having a free end and exhibiting a length generally defined between said free end of said toe portion and said curved portion.

7. The barrier of claim 6, wherein said length of said toe portion is between about ten percent and about thirty-five percent of said height of said hollow body, and wherein said length of said toe portion is configured to help produce a resisting overturning moment to help prevent said hollow body from being tipped over during use.

8. The barrier of claim 6, wherein said length of said toe portion is between about fifteen percent and about twenty-five percent of said height of said hollow body.

9. The barrier of claim 6, wherein said length of said toe portion is between about six times and four times greater than a thickness of said toe portion.

10. The barrier of claim 6, wherein said plurality of channels substantially extend between said top portion, said curved portion of said foot member, and said free end of said toe portion.

11. The barrier of claim 10, further comprising:

a plurality of protrusions on said top portion of said hollow body, one or more of said protrusions exhibiting a generally rectangular geometric shape sized and configured to generally correspond to a portion of one or more of said channels.

12. The barrier of claim 10, further comprising one or more stake ports positioned on said curved portion of said foot member and extending between said channels in said foot member and said bottom portion, said stake ports being configured to help reinforce said foot member against one or more internal forces and/or one or more external forces.

13. The barrier of claim 12, wherein said one or more stake ports are further configured to receive a stake, post, rod, or spike for insertion into a support surface below said bottom portion.

14. The barrier of claim 1, further comprising:

a plurality of support rods extending between said back wall and said front wall, said support rods being configured to help reinforce said hollow body against one or more internal forces and/or one or more external forces.

15. The barrier of claim 14, wherein one or more of said support rods exhibit a generally rectangular geometric shape, and wherein said one or more of said support rods further comprise handles to lift the barrier.

16. The barrier of claim 1, wherein one or more of said support rods exhibit a generally cylindrical geometric shape, and wherein said one or more of said support rods further comprise lift pole ports configured to receive one or more lifting poles.

17. The barrier of claim 1, wherein one or more of said support rods exhibit a generally cylindrical geometric shape, wherein said one or more of said support rods further comprise strap ports configured to receive one or more strap members.

18. The barrier of claim 1, wherein said connection member includes a generally conical body portion, and a tapered end portion substantially adjacent to said top portion.

19. A water management barrier comprising:

a hollow body at least partially defined by a front wall, a back wall, a top portion extending between said front wall and said back wall, a bottom portion generally opposite said top portion, a first end extending between said top portion and said bottom portion, and a second end extending between said top portion and said bottom portion; said hollow body exhibiting a height generally defined between said top portion and said bottom portion, wherein said hollow body is configured to receive one or more materials to at least partially fill said hollow body;

an elongated connection member connected to said first end and generally extending between said top portion and said bottom portion;

a connection recess formed in said second end, said connection recess being sized and configured to generally correspond to at least a portion of said connection member; and a foot member attached to said back wall, said foot member including a curved portion and a toe portion extending from said curved portion, said toe portion exhibiting a length generally defined between said curved portion and a free end of said toe portion, wherein said length of said toe portion is between about ten percent and about one-hundred percent of said height of said hollow body, and wherein said length of said toe portion is configured to help produce a resisting overturning moment to help prevent said hollow body from being tipped over during use.

20. A water management wall comprising a first water management barrier rotatably connected to a second water management barrier, wherein at least one of the first water management barrier or the second water management barrier comprises the water management barrier of claim 1 or the water management barrier of claim 19.

21. A method of storing water management barriers, the method comprising:

providing a first water management barrier and a second water management barrier, each of said first water management barrier and second water management barrier including:

a hollow body at least partially defined by a front wall, a back wall, a top portion extending between said front wall and said back wall, and a bottom portion generally opposite said top portion;

a foot member substantially adjacent said bottom portion and extending outward from said back wall, said foot member including a toe portion extending therefrom;

a plurality of channels extending along said back wall between said top portion and said toe portion of said foot member; and one or more protrusions on said top portion, said one or more protrusions exhibiting a generally rectangular geometric shape;

stacking said first water management barrier on said second water management barrier such that said one or more protrusions of said first water management barrier are positioned within one or more of said channels on said foot member of said second water management barrier and said one or more protrusions of said second water management barrier are positioned within one or more of said channels on said foot member of said first water management barrier.

22. The method of claim 21, wherein said one or more protrusions of said first water management barrier are selectively lockable within said one or more channels on said foot member of said second water management barrier.

* * * * *